US010497205B2

(12) United States Patent
Yamaguchi

(10) Patent No.: US 10,497,205 B2
(45) **Date of Patent: *Dec. 3, 2019**

(54) GAME MEDIUM ACCOMMODATION DEVICE

(71) Applicant: Universal Entertainment Corporation, Koto-ku, Tokyo (JP)

(72) Inventor: Shinsuke Yamaguchi, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 87 days.

This patent is subject to a terminal disclaimer.

(21) Appl. No.: 15/095,030

(22) Filed: Apr. 9, 2016

(65) Prior Publication Data

US 2016/0307397 A1 Oct. 20, 2016

(30) Foreign Application Priority Data

Apr. 15, 2015 (JP) ..... 2015-083535

(51) Int. Cl.
*G07F 17/32* (2006.01)

(52) U.S. Cl.
CPC ..... *G07F 17/3227* (2013.01); *G07F 17/3251* (2013.01)

(58) Field of Classification Search
CPC .. G07F 17/3227; G07F 17/3251; G07F 17/34; G07F 17/3234
See application file for complete search history.

(56) References Cited

U.S. PATENT DOCUMENTS

2004/0229682 A1* 11/2004 Gelinotte ..... G06K 7/0008 463/25
2007/0026949 A1* 2/2007 Charlier ..... G06K 19/07796 463/47
2011/0227703 A1* 9/2011 Kotab ..... G07F 17/32 340/10.1
2012/0105215 A1* 5/2012 Gronau ..... G07F 17/322 340/10.51
2013/0292901 A1* 11/2013 Kneitel ..... A63F 11/00 273/148 R
2014/0339107 A1* 11/2014 Gelinotte ..... G07G 1/00 206/216

* cited by examiner

*Primary Examiner* — Jay Trent Liddle
*Assistant Examiner* — Ryan Hsu
(74) *Attorney, Agent, or Firm* — Potomac Law Group, PLLC; Kenneth Fagin

(57) ABSTRACT

Equivalent exchange operation of exchanging a game medium for another type of game medium is performed in a shorter time. A game medium accommodation device includes: a tray mechanism configured to hold a plurality of accommodation cases stacked in an up-down direction along a reading surface continuing in the up-down direction, each of the accommodation cases accommodating a bundle of game media aligned in a horizontal direction; and an antenna board disposed on the reading surface. The game medium accommodation device reads electronic information relating to the game media and stored in the game media, by radio communication between the antenna board and the game media.

5 Claims, 37 Drawing Sheets

FIG.3

| REGION | BLOCK REGION | DATA | DATA READING | DATA WRITING |
|---|---|---|---|---|
| USER REGION | 0～57 | Reserved for user | ○ | ○ |
| SYSTEM REGION | A | Reserved for future | ○ | × |
| | B | 64-BIT UID (IDENTIFICATION INFORMATION) | ○ | × |
| | C | | | |
| | D | 8-BIT DSFID (SECOND ERROR DETECTING CODE) 4-BIT AFI (GROUP CODE) etc. | ○ | △ |
| | E | Block security | ○ | × |
| | F | | | |

FIG.9

| GAME MEDIUM MANAGEMENT DATABASE | | |
|---|---|---|
| IDENTIFICATION INFORMATION (64-BIT UID) | GROUP CODE (10-BIT AFI) | LOG |
| ---------- | ---------- | ---------- |
| ---------- | ---------- | ---------- |
| ---------- | ---------- | ---------- |

FIG.10

GAME MEDIUM INFORMATION TABLE

| IDENTIFICATION INFORMATION | ATTRIBUTE | AMOUNT | DENOMINATION |
|---|---|---|---|
| ID001 | JUNKET NN | 100 | HKD |
| ID111 | JUNKET NN | 100 | HKD |
| ID123 | JUNKET NN | 100 | HKD |
| ID222 | JUNKET NN | 200 | PHP |
| ID337 | JUNKET CASH | 300 | HKD |
| ID021 | JUNKET CASH | 100 | PHP |
| ... | ... | ... | ... |
| ID173 | JUNKET NN | 100 | HKD |
| ID521 | JUNKET CASH | 100 | PHP |
| ID317 | JUNKET CASH | 300 | HKD |
| ID282 | JUNKET NN | 200 | PHP |
| ... | ... | ... | ... |

GAME MEDIUM ACCOMMODATION DEVICE

CROSS REFERENCE TO RELATED APPLICATION

The present application claims priority from Japanese Patent Application No. 2015-083535, which was filed on Apr. 15, 2015, the disclosure of which is herein incorporated by reference in its entirety.

FIELD OF THE INVENTION

The present invention relates to a game medium accommodation device for accommodating a game medium such as a plaque and a chip used in a game.

BACKGROUND OF THE INVENTION

In a game place such as a casino, the following system is adopted: one or more game media such as a casino chip and a plaque are stored for exchanging currency offered by a player with the gaming medium (media) the amount of which corresponds to its currency value; or one or more game media owned by a player are stored and exchanged with currency equivalent thereto.

As a known device used to store a game medium, for example, there is a portable reader described in Published Japanese Translation of PCT Application No. JP 2013-544005. The portable reader includes a horizontally disposed housing having a currency reading surface; a shielded antenna disposed on the currency reading surface; and a display provided to the housing. The portable reader is configured to read information from RFID (Radio Frequency IDentification) tags embedded within a plurality of gaming currencies placed on the currency reading surface, and to display the total amount of the gaming currencies on the display.

However, because the known portable reader has a configuration in which the game media are placed on the horizontally disposed currency reading surface, it is necessary to ensure an installation location corresponding to the size of the currency reading surface, and as a result, the degree of freedom in the installation location tends to be low. In particular, when it is intended to store a large number of game media, the reduction of the degree of freedom in the installation location is remarkable.

Accordingly, an object of the present invention is to provide a game medium accommodation device capable of increasing the degree of freedom of the installation location while storing a large number of game media.

BRIEF SUMMARY OF THE INVENTION

A game medium accommodation device according to an embodiment of the present invention includes a tray mechanism including a reading surface, the tray mechanism being configured to hold a plurality of accommodation cases stacked in an up-down direction along the reading surface continuing in the up-down direction, each of the accommodation cases accommodating a bundle of game media aligned in a horizontal direction; and a reading mechanism including an antenna disposed on the reading surface, the reading mechanism being configured to read electronic information relating to the game media and stored in the game media by radio communication between the antenna and the game media.

According to the configuration described above, the accommodation cases each accommodating the bundle of the game media are stacked in an up-down direction along the reading surface, and thereby a positional relationship between the accommodation cases disposed in the tray mechanism and the antenna of the reading mechanism is kept in a state where the electronic information of the game media is readable. Therefore, provided is a vertical type game medium accommodation device with a high degree of freedom in the installation location.

Further, the game medium accommodation device may be arranged such that the tray mechanism is configured to allow the accommodation cases to be stacked in M rows and N columns, and a reading region of the antenna is set along each row of the M rows, in each of which rows, N accommodation cases are lined up in the horizontal direction.

According to the configuration described above, for each of the plurality of accommodation cases each having N accommodation cases lined up in the horizontal direction, a reading region of the antenna is set for each of the M rows, so that electronic information of the game media accommodated in the accommodation cases disposed along the reading surface is read by the different antennas respectively corresponding to the rows.

Further, the game medium accommodation device may be arranged such that: each of the game media accommodated in the accommodation cases has a semiconductor device storing the electronic information and embedded at a center portion of each of the game media, and the game media include, with respect to their outer shapes, different types of game media which are different in a size in a height direction of the game media aligned in the horizontal direction; each accommodation case includes a plurality of accommodation portions each configured to accommodate the game media, and a spacer member attachable/detachable with respect to at least one of these accommodation portions; and the spacer member regulates positions of the center portions of the game media relative to the reading region so as to satisfy a predetermined positional relationship even when the game media are of different types which are different in the size.

According to the configuration described above, when the game media with different sizes are lined up in the horizontal direction and accommodated in the tray mechanism, the center portions of the game media arranged in the horizontal direction are located at the same height relative to the reading region of the antenna by virtue of the spacer member, and this enables the reading mechanism to read the electronic information of the game media by radio communication more stably.

The game medium accommodation device may be arranged such that: the tray mechanism forms a placing surface of the accommodation cases which surface extends in the horizontal direction from the reading surface, and the placing surface is formed to be inclined so that the accommodation cases are able to be stacked in the up-down direction along the reading surface.

According to the configuration described above, when the accommodation cases are stacked in the up-down direction along the reading surface, the inclined placing surface on which the accommodation cases are placed makes it possible to keep a state where the group of the accommodation cases stacked in the up-down direction (vertical direction) lean against the placing surface along the placing surface. Therefore, the risk that the game medium may fall to the side opposite to the reading surface side by its own weight can be reduced, and the risk that the communication distance between the antenna of the reading surface and the game medium increases to deteriorate the performance of the radio communication can be reduced.

The game medium accommodation device may be arranged such that a space of the tray mechanism facing the reading surface is open to expose a group of the stacked accommodation cases accommodated in the tray mechanism to outside.

According to the configuration described above, while maintaining the state where the accommodation cases are along the reading surface and lean against the reading surface by stacking the accommodation cases, the space facing the reading surface is open to be visible from the outside. This makes it easier to handle the bundle of game media in each accommodation case.

The game medium accommodation device may include: a display device; and a control device configured to obtain a total value of game value for each type of the game media based on the electronic information read by the reading mechanism, and to display the one or more total values on the display device in association with the type of the game media.

According to the configuration described above, it is possible to visually check the type(s) and total value(s) of the game media accommodated in the game medium accommodation device immediately because the total values of the game values are displayed on the display device in association with the type of the game medium.

With the present invention, the degree of freedom of the installation location is increased while storage of a number of game media is achieved.

BRIEF DESCRIPTION OF THE DRAWINGS

FIG. 3 is an explanatory drawing showing a memory region of the RFID tag contained in the game medium.

FIG. 9 is an explanatory drawing of a game medium management database.

FIG. 10 is an explanatory drawing of a game medium information table.

DETAILED DESCRIPTION OF THE PREFERRED EMBODIMENT

Embodiment 1

The game medium accommodation device according to the first embodiment of the present invention will be described based on the figures.

(Outline of Game Medium Accommodation Device 1)

Figure 1:
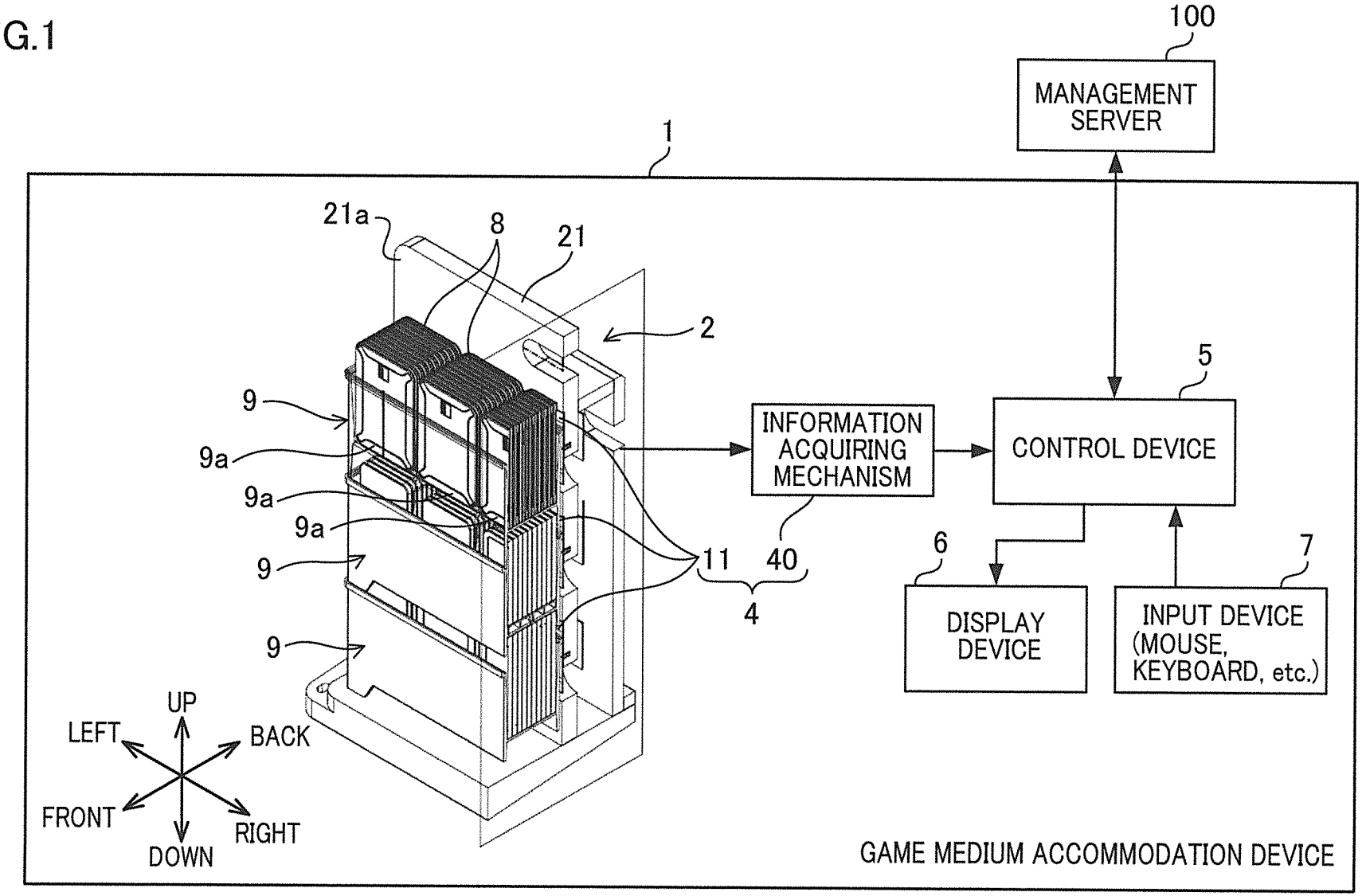
FIG. 1 is a block diagram showing a schematic configuration of a game medium accommodation device of the first embodiment.

As shown in FIG. 1, the game medium accommodation device 1 is configured to accommodate one or more game media 8 each having game medium information in such a manner that the game medium information can be output by radio communication.

Here, as the type (attribute) of the game medium 8, there are a convertible game medium and an inconvertible game medium such as a medal, token, and plaque. Each game media is configured to have a game value of currency information or a game point in the form of electronic data and/or exterior shape, the game value being readable from outside. The exterior shape is a shape identifiable from outside such as a color, pattern, character, image, shape and the like. Further, the convertible game medium indicates the game medium that can be used in a game in a game place such as a casino, and can be directly exchanged for currency. As the convertible game medium, for example, there is a negotiable plaque. Further, the inconvertible game medium indicates the game medium that can be used in a game in a game place such as a casino, but cannot be directly exchanged for currency. As the inconvertible game medium, for example, there is a non-negotiable plaque.

As shown in FIG. 1, the game medium accommodation device 1 includes a tray mechanism 2 and a reading mechanism 4. The tray mechanism 2 is configured to allow a plurality of accommodation cases 9 accommodating the game media 8 to be stacked in an up-down direction along a reading surface 21*a* continuing in the up-down direction. Each accommodation case 9 is capable of accommodating one or more bundles each formed of game media 8 aligned in the horizontal direction. In the accommodation case 9, one or more such bundles of the game media 8 can be arranged. The reading mechanism 4 includes antenna boards 11 disposed on the reading surface 21*a*, and an information acquiring mechanism 40 configured to acquire the electronic information of the game media 8 arranged in the tray mechanism 2 via the antenna boards 11. The reading mechanism 4 is capable of reading the electronic information relating to game medium 8 and stored inside the game media 8, by radio communication between the antenna boards 11 and the game media 8.

It should be noted that, in the following description, the horizontal side (direction) on (in) which the game media 8 are held relative to the reading surface 21*a* of the tray mechanism 2 may be referred to as a front side (front direction) of the game medium accommodation device 1, the side opposite to the front side may be referred to as a rear side (back direction, depth direction), and the right side and left side viewed from the front side may be referred to as a right side (right direction) and a left side (left direction) of the game medium accommodation device 1 respectively. Further, the direction including the front side and the rear side may be referred to as a front-back direction, and the direction including the right side and the left side may be referred to as a left-right direction. The direction perpendicular to the front-back direction (thickness direction) and the left-right direction (width direction) may be referred to as an up-down direction or a height direction.

In this configuration, the plurality of accommodation cases 9 accommodating the bundles of game media 8 are aligned in the up-down direction along the reading surface 21*a*, and therefore a positional relationship of the plurality of accommodation cases 9 and the antenna boards 11 of the reading mechanism 4 can be kept in a state where the electronic information of the game media 8 can be read. Therefore, a vertical type game medium accommodation device with high degree of freedom of the installation location can be made.

Incidentally, the electronic information relating to the game medium 8 includes, for example, identification information, attribute, amount, denomination, issuer, issue date, and expiration date etc. set in the game medium 8. The identification information is the information for uniquely identifying the game medium 8. The amount is the information of the game value that the game medium 8 has. The denomination is the information indicating in which country's currency distribution unit the amount of the game medium 8 is set. The issuer is the information indicating the person or the like who issues the game medium 8. Incidentally, the issuer may be the information identifying the person who passes the game medium 8 to the player. For example, if the game place such as a casino directly issues the game medium 8 to the player, the issuer is the game place. If the game medium 8 issued by the game place is passed to the player via a junket, the issuer is the information identifying the junket. Hereafter, the electronic information of the game medium 8 may be referred to as game medium information.

Also, the game medium accommodation device 1 includes a display device 6 and a control device 5. The display device 6 employs a device displaying characters, image or video, such as a liquid crystal display, a plasma display, an organic EL display and the like. The control device 5 is configured to obtain the total value of the game values for each type of the game media 8 based on the electronic information read by the reading mechanism 4, and display these total values on the display device 6 in association with the type of the game media 8. That is, in the present embodiment, the game medium 8 stores at least the attribute and the amount as the electronic information so that they are acquirable from outside. Thus, the game medium accommodation device 1 displays the total values of the game values on the display device 6 in association with the type of the game media 8, and this makes it possible to visually check the type and total values of the game media 8 accommodated in the game medium accommodation device 1 immediately.

Thus, the reading mechanism 4 is configured to acquire the game medium information including the game value of each game medium 8 arranged in the tray mechanism 2. The method for acquiring the game medium information may be a radio communication system in which the game medium information stored in the memory of the game medium 8 is read by radio communication, or may be an optical reading system in which the game medium information incorporated in the exterior shape of the game medium 8 is read optically. Alternatively, the radio communication system and the optical reading system may be combined with each other.

The control device 5 may display the type and the accommodation position of the game medium 8 on the display device 6. In this case, when taking out a from the tray mechanism 2 from a number of game media 8 accommodated in the tray mechanism 2 in a matrix form, the desired type of game medium 8 can be taken out quickly since the accommodation position can be checked on the display device 6.

Further, the control device 5 may be configured to identify the currency unit of the game value based on the electronic information acquired by the reading mechanism 4, and to provide color-coding display with respect to the currency unit. With the thus configured game medium accommodation device 1, it is possible to recognize the accommodation state of each game medium 8 easily by displaying information of the game medium 8 with color coding with respect to the currency unit.

Further, the control device 5 may be configured to identify the type of the game medium 8 based on the game medium information acquired by the reading mechanism 4, and to provide color-coding display with respect to the type of game medium. With the thus configured game medium accommodation device 1, it is possible to recognize the accommodation state of the game medium 8 easily because information of the game medium is displayed with color coding with respect to the type.

(Details of Game Medium Accommodation Device 1)

The above-mentioned game medium accommodation device 1 will be described in detail. Incidentally, in the following description, although a case where the game media 8 are plural types of differently sized rectangular flat plate-shaped plaques will be described, the present invention is not limited thereto.

(Game Medium)

Figure 2:
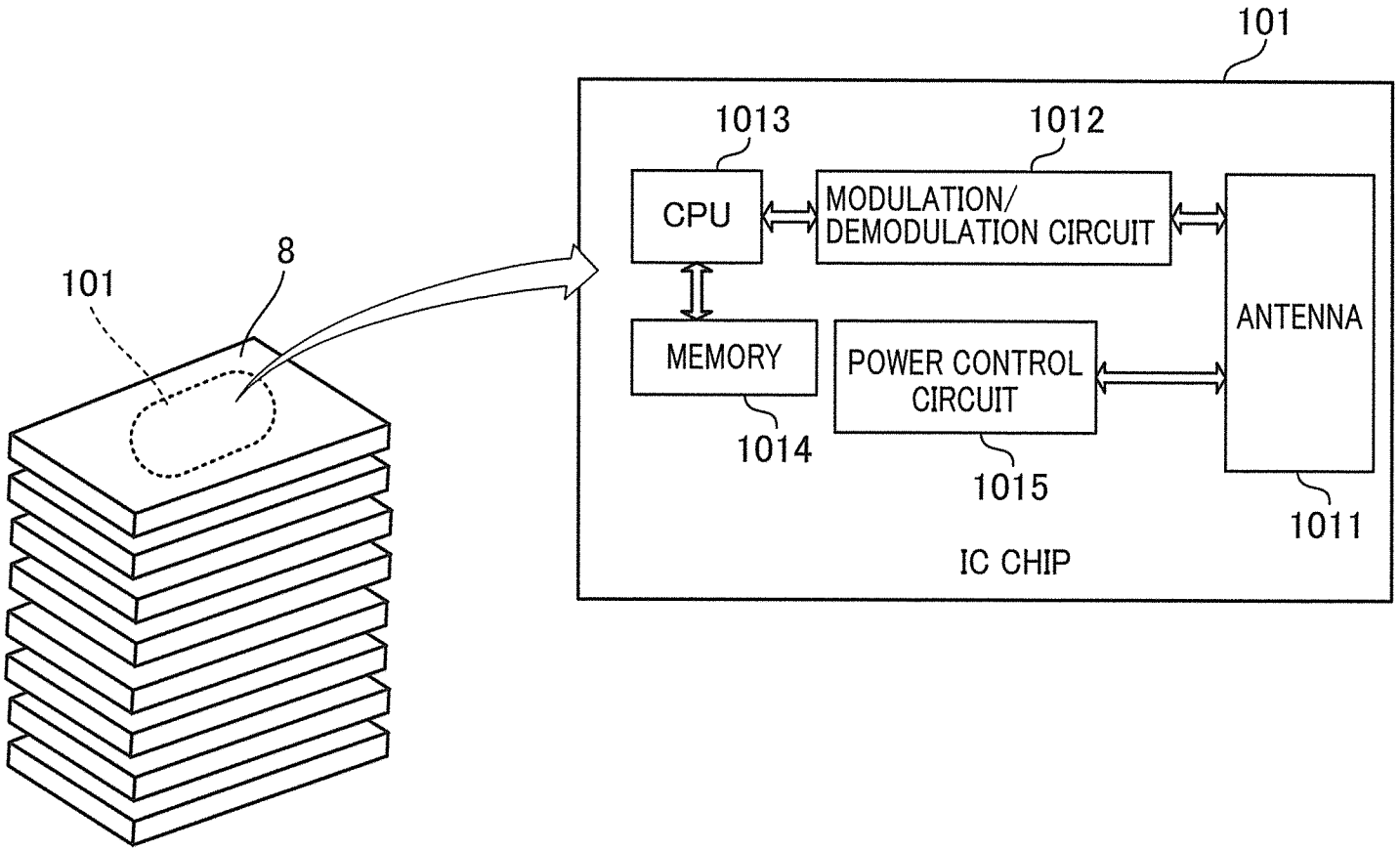
FIG. 2 is an explanatory drawing showing an electrical configuration of a RFID tag contained in the game medium.

As shown in FIG. 2, the game media 8 are storage media to be exchanged instead of cash between, for example, a dealer and a player in a game arcade such as a casino. Each game medium 8 is generally made of resin or the like. The game medium 8 contains an RFID tag 101 at the center thereof. The RFID tag 101 is an IC chip used for RFID.

The RFID tag 101 includes an antenna 1011, a modulation/demodulation circuit 1012, a CPU1013, a memory 1014, and a power control circuit 1015. The memory 1014 stores the above-mentioned electronic information such as identification information. The CPU1013 executes an operation of interpreting a command, request, instruction, and the like issued by the reading mechanism 4 of FIG. 6, and responding thereto. The modulation/demodulation circuit 1012 performs modulation/demodulation of signals to transmit/receive the game medium information such as identification information by radio with the reading mechanism 4.

The antenna 1011 is a so-called loop antenna, which is formed by a conducting wire formed in an annular shape (loop shape). The antenna 1011 generates an induced current by a transmitted magnetic field, so that the induced current is used as a driving power of the RFID tag 101 via the power control circuit 1015. Thus, a semiconductor device storing the electronic information is embedded at the center portion of each game medium 8 accommodated in the accommodation case 9.

As shown in FIG. 3, the memory 1014 is formed of a nonvolatile RAM storing the game medium information, and has a memory region of 256 bytes, for example. The memory region of 256 bytes is divided into 64 blocks of 4 bytes each. Among the 64 blocks, 58 blocks are allocated to a user region (block numbers 0 to 57), and 6 blocks are allocated to a system region (block numbers A to F). That is, the storage section 43 includes a user region and a system region. The user region is a region that can be accessed by designation of a block address. The system region is a region that can be accessed by a predetermined command only.

Among the system regions A to F, the block A is a region for the future. In the block B and block C, a 64-bit UID is stored. In the block D, such as DSFID, AFI are stored. In the present embodiment, DSFID is a one-byte data generated by CRC (Cyclic Redundancy Check) from the UID. It should be noted that the CRC used herein means the CRC function, and a value generated by the CRC function is referred to as a CRC code. That is, DSFID is a one-byte CRC code. DSFID is a second error detecting code. AFI is a group code. In the block E and block F, data in the block security state is stored. The details of the reading process for reading the game medium information by using the data of each region of the memory 1014 will be describe later.

(Game Medium Accommodation Device 1: Accommodation Case 9)

Figure 4A:
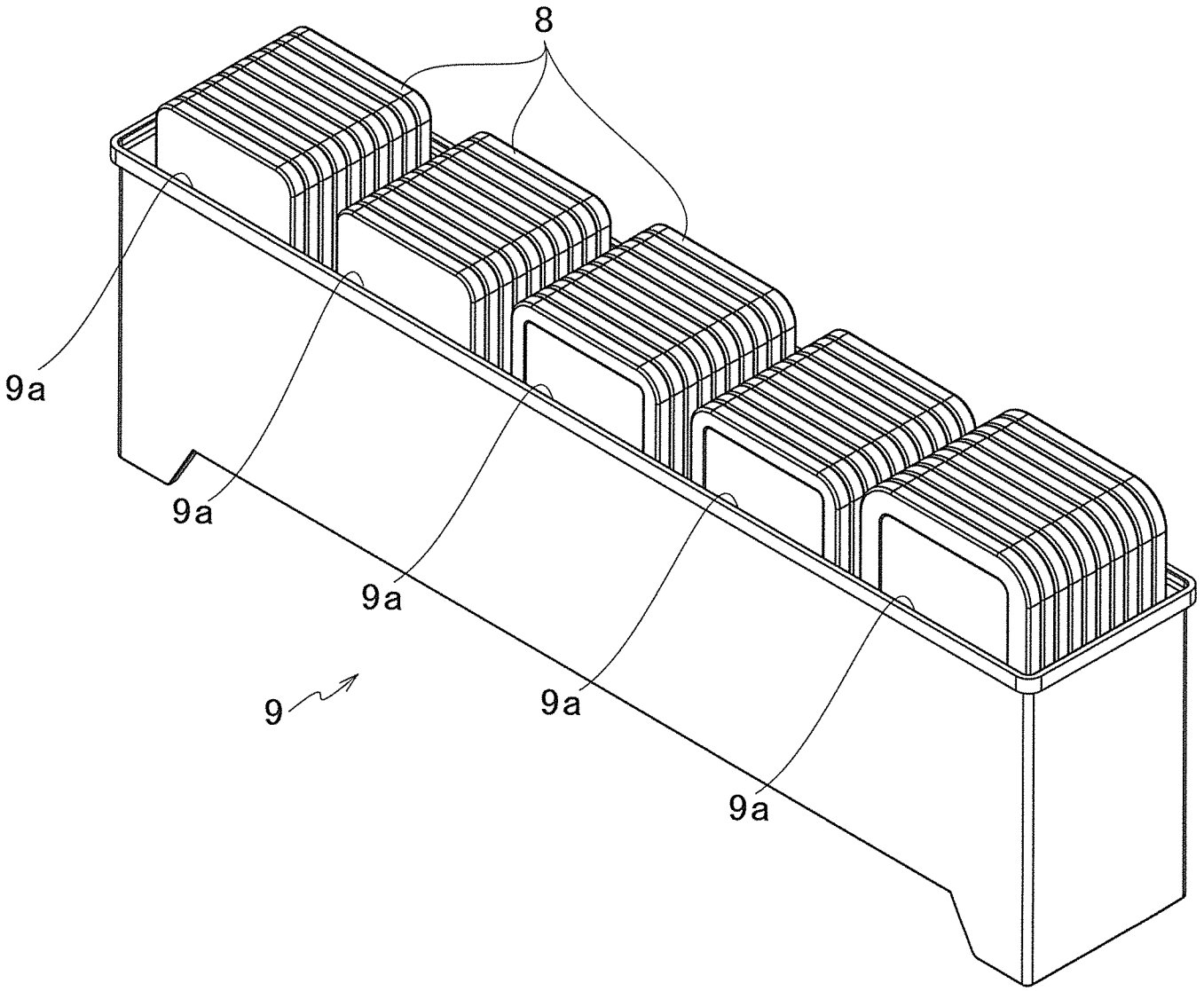
FIG. 4A is a perspective view of an accommodation case.

As shown in FIG. 4A, the accommodation case 9 has five accommodation portions 9*a* provided in the horizontal direction. Each accommodation portion 9*a* is capable of accommodating a bundle formed of ten game media 8 aligned with one another. Each game media 8 contains an RFID tag 101 at the center portion as described above. Each accommodation portion 9*a* accommodates the bundle of game media 8 stacked in a direction perpendicular to the direction in which the five accommodation portions 9*a* are lined up. Thus, each accommodation case 9 is capable of accommodating fifty plaques (game media 8).

Figure 4B:
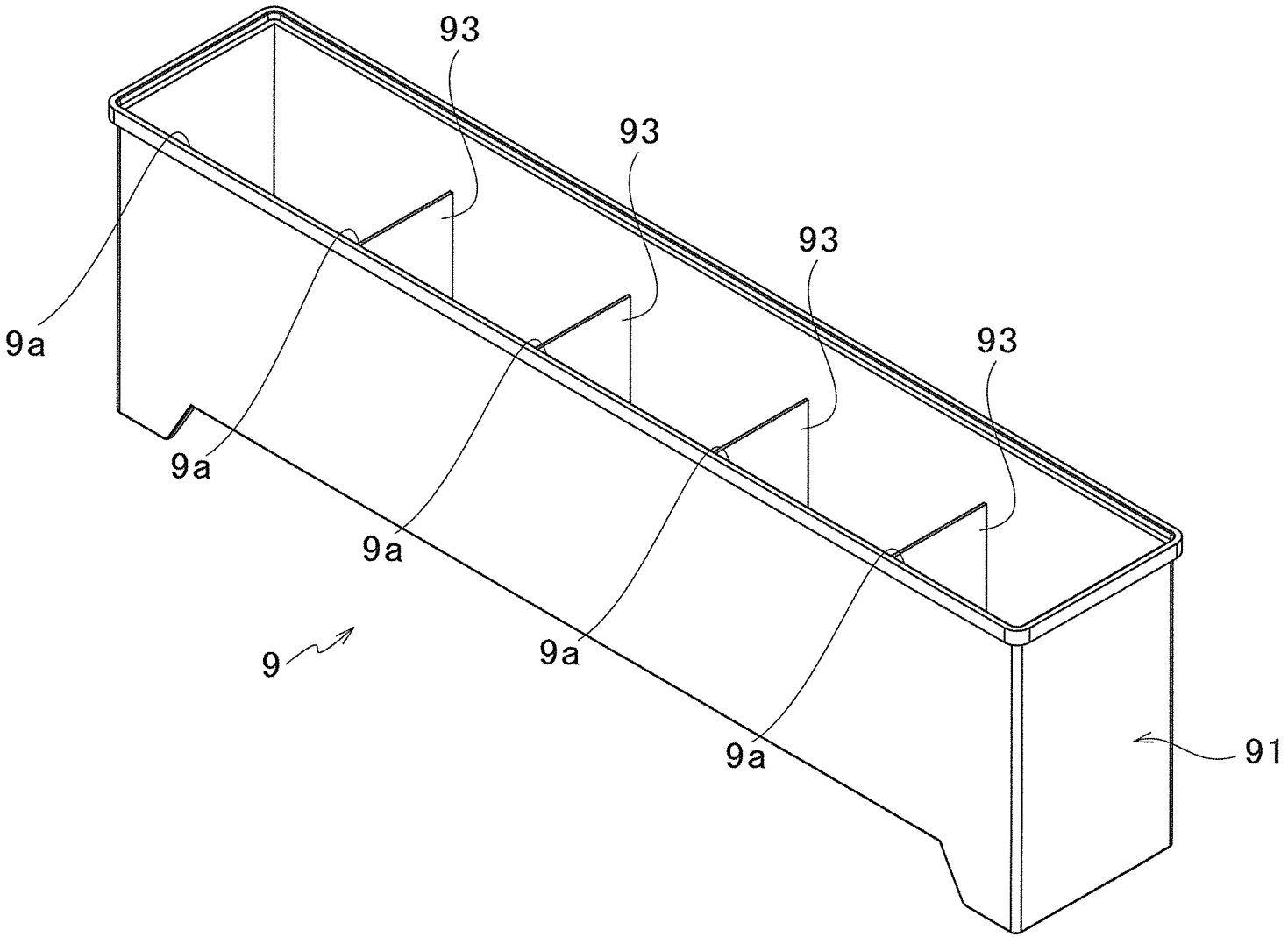
FIG. 4B is a perspective view of the accommodation case.
Figure 4C:
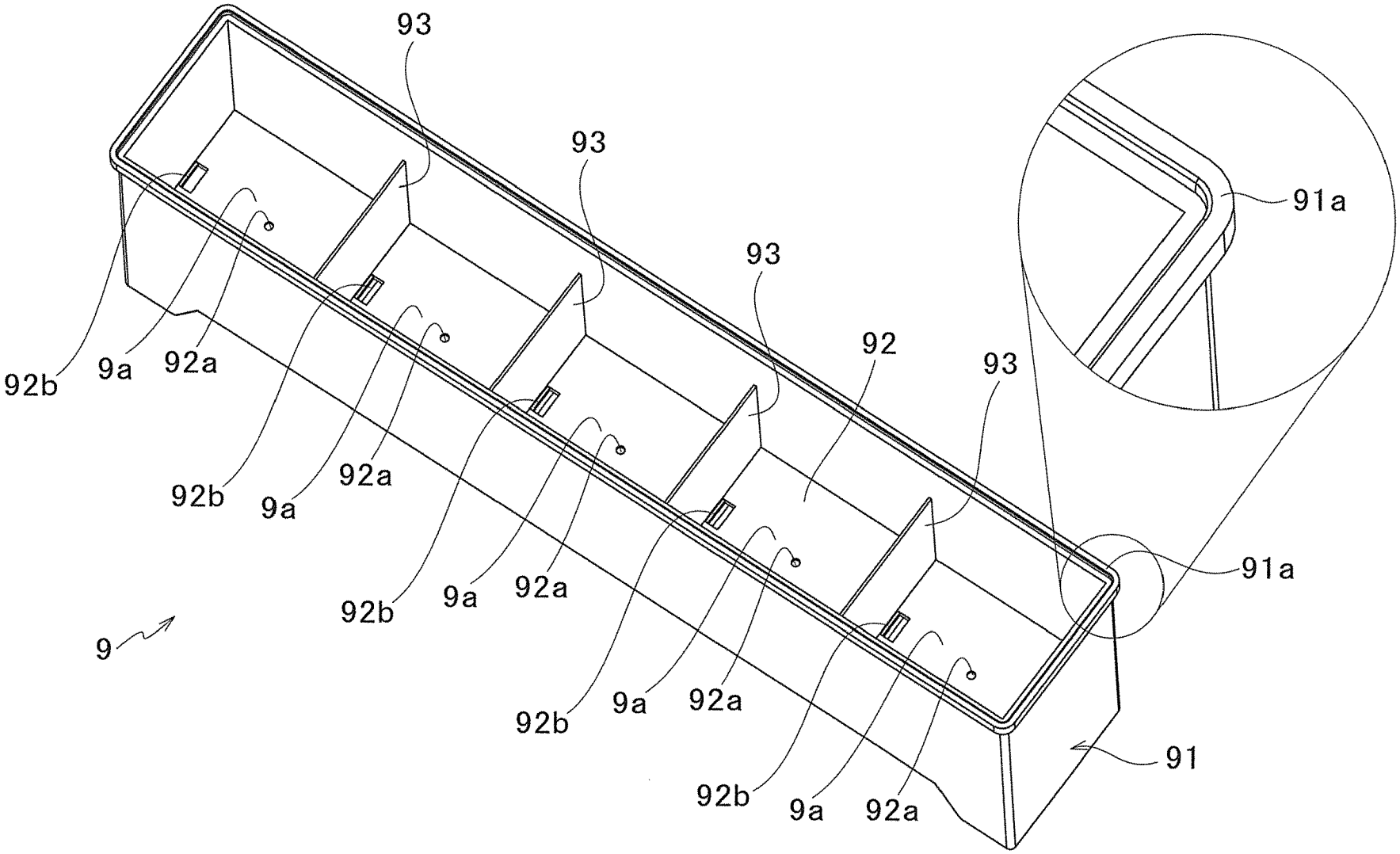
FIG. 4C is a perspective view of the accommodation case.

As shown in FIG. 4B and FIG. 4C, the accommodation case 9 has a side wall 91, a bottom wall 92, and four partitioning plates 93. The side wall 91 is formed in a rectangular tube shape with an open top and an open bottom.

Figure 4D:
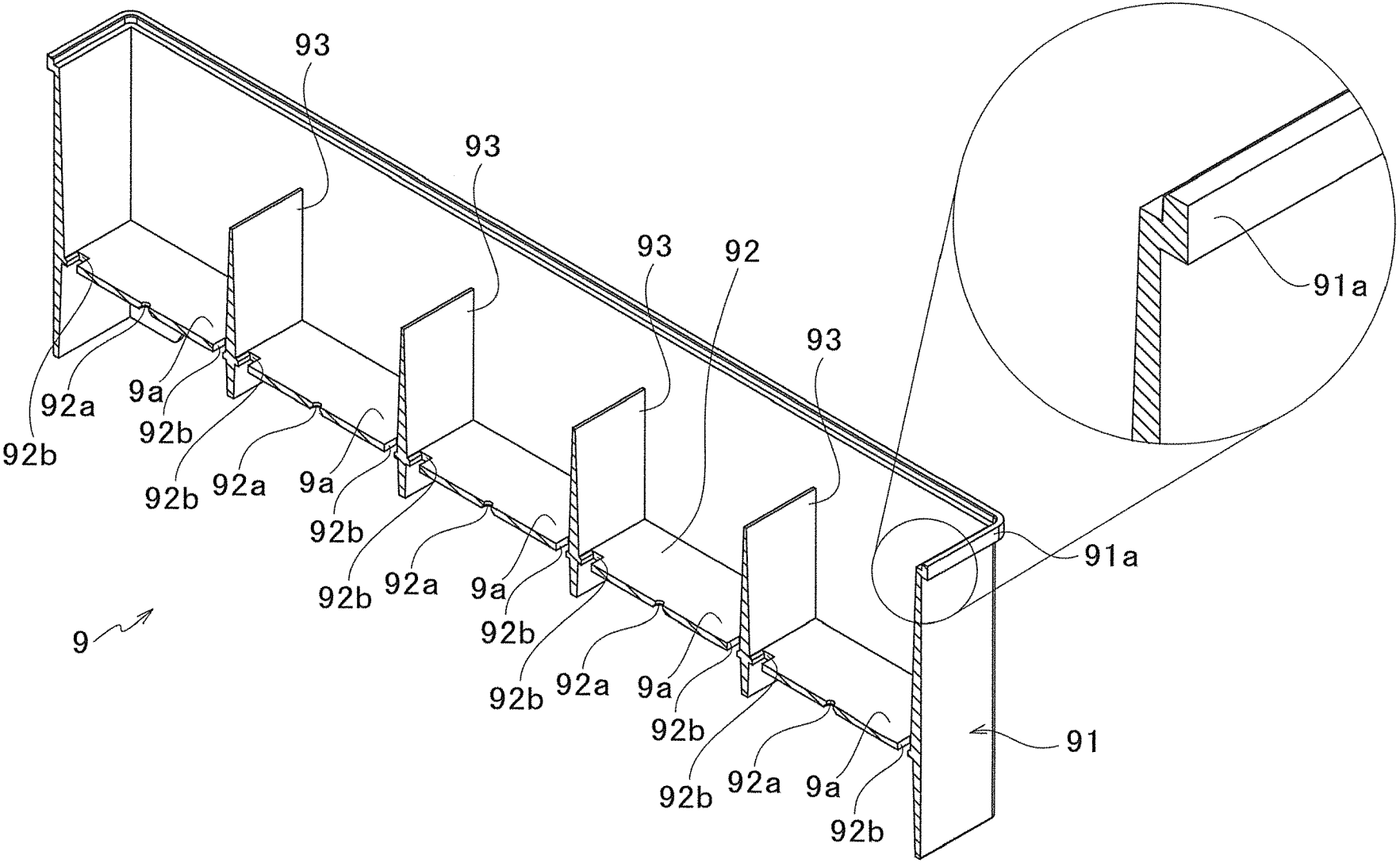
FIG. 4D is a cross-section view of the accommodation case.

As shown in FIG. 4C and FIG. 4D, an edge portion of the open top of the side wall 91 has a fitting portion 91*a* having a stepwise cross section and having a larger inner diameter. The inner diameter of the fitting portion 91*a* is set to be larger than the outer diameter of an edge portion of the open bottom of the side wall 91 of the accommodation case 9. Thus, in the fitting portion 91*a* of the accommodation case 9, the lower edge of another accommodation case 9 can be fitted, and this enables the plurality of accommodation cases 9 to be stacked in the up-down direction stably.

Thus, the accommodation case 9 can be stacked in the up-down direction in the tray mechanism 2. Accordingly, in the game medium accommodation device 1, the plurality of game media 8 can be handled in the unit of the accommodation case 9, and therefore the operation of arranging the bundles of the game media 8 in the horizontal direction and the up-down direction with respect to the tray mechanism 2 can be performed easily.

As shown in FIG. 4C, the bottom wall 92 is formed in a flat plate shape, and is disposed, to constitute the bottom surface of the accommodation portion 9*a*, at a position higher than the lower edge of the side wall 91. That is, the accommodation case 9 is formed in a shape having a raised bottom. Thus, as shown in FIG. 4A, top portions of the game media 8 accommodated in the accommodation case 9 are exposed from the accommodation case 9. Therefore, the operation of taking out the game medium 8 accommodated in the accommodation case 9 can be easily performed. Further, in the bottom wall 92, a penetration hole 92*a* for releasing air when inserting the laminated game media 8 is formed in the region of each accommodation portion 9*a*. Thus, the air resistance at the time of inserting the bundle of the game media 8 in the accommodation portion 9*a* is reduced. Further, in the bottom wall 92, fixing holes 92*b* used to dispose spacer members 10 are formed. The spacer members 10 will be described in detail later.

As shown in FIG. 4B, FIG. 4C, and FIG. 4D, the four partitioning plates 93 each is formed in a flat plate shape, and are provided to partition the space inside the accommodation case 9 into five lined-up accommodation portions 9*a*. The partitioning plates 93 are provided vertically from the bottom wall 92 in the up-down direction. The thickness of each partitioning plate 93 decreases as it goes upward from the bottom wall 92, and the thickness decreases as it goes downward from the bottom wall 92. Incidentally, the thickness of the side wall 91 similarly decreases as it goings upward from the bottom wall 92, and the thickness decreases as it goes downward from the bottom wall 92. Thus, each game medium 8 inserted into the accommodation portion 9*a* is easily taken out.

(Game Medium Accommodation Device 1: Spacer Member 10)

Figure 5A:
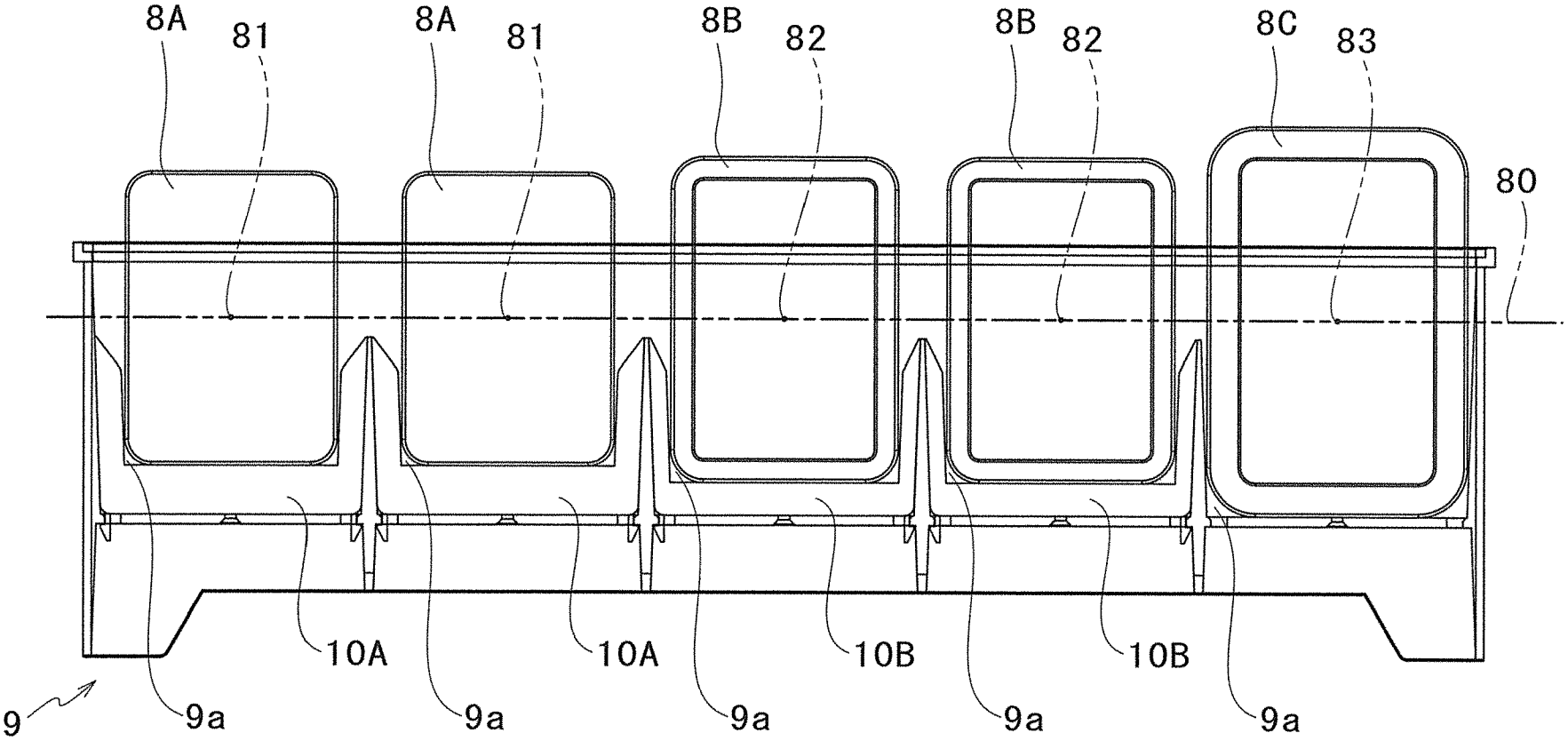
FIG. 5A is a partial perspective front view showing a state in which game media are accommodated in the accommodation case through spacer members.

As shown in FIG. 5A, the accommodation case 9 has spacer members 10 attachable to/detachable from the respective accommodation portions 9*a*. Each spacer member 10 is formed so that the center portions of game media 8 of various sizes are set at the same distance from the bottom surface of the accommodation case 9. That is, depending on the size of the game media 8, the type of the spacer member 10 for setting the center portions of the game media 8 at the same position is selected. In the present embodiment, the selection can be made from the spacer member 10A, and the spacer member 10B because the accommodation case 9 is capable of accommodating the small-sized game medium 8A, the medium-sized game medium 8B, and the large-sized game medium 8C.

As shown in FIG. 5A, the game medium 8A can be accommodated in the accommodation portion 9*a* to which the spacer member 10A is attached. Further, the game medium 8B can be accommodated in the accommodation portion 9*a* to which the spacer member 10B is attached. Further, the game medium 8C can be accommodated in the accommodation portion 9*a* to which any of the spacer members 10A and 10B is not attached. Then, the center portions 81, 82, and 83 of thus accommodated game media 8A, 8B, and 8C of various sizes are set at a same distance from the bottom surface of the accommodation case 9, and have the same distance from the bottom surface. That is, in the present embodiment, heights of the spacer members 10A and 10B are set in accordance with the position of the center portion of the game medium 8C accommodated in the accommodation portion 9*a*.

Figure 5B:
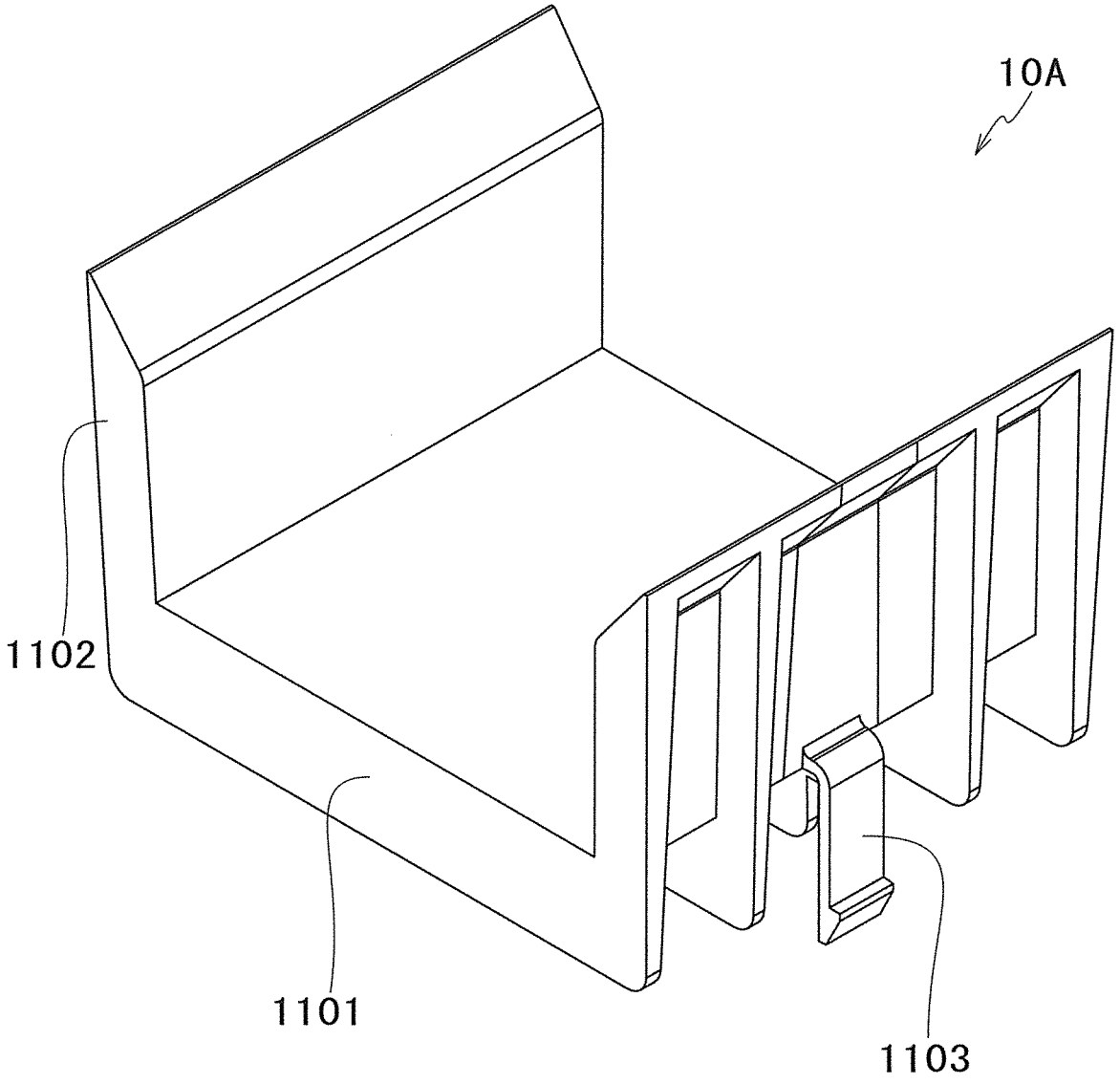
FIG. 5B is a perspective view of a spacer member.

As shown in FIG. 5B, the spacer member 10A is formed in a recessed shape for forming the space accommodating the game medium 8A. Specifically, the spacer member 10A includes: a bottom surface portion 1101; two side surface portions 1102 raised from two opposed sides of the bottom surface portion 1101 respectively; and two hook portions 1103 (only one is shown in the figure). Each hook portion is bent downward after protruding sideward from a region of the corresponding side surface portion 1102 in which the thickness of the side surface portion 1102 is reduced, and each hook portion has a claw portion at its end portion. The thickness of the bottom surface portion 1101 of the spacer member 10A is adjusted so that the center portion of the game medium 8A accommodated in the spacer member 10A is located at the distance 80 (see FIG. 5A) from the bottom surface of the accommodation case 9.

Figure 5C:
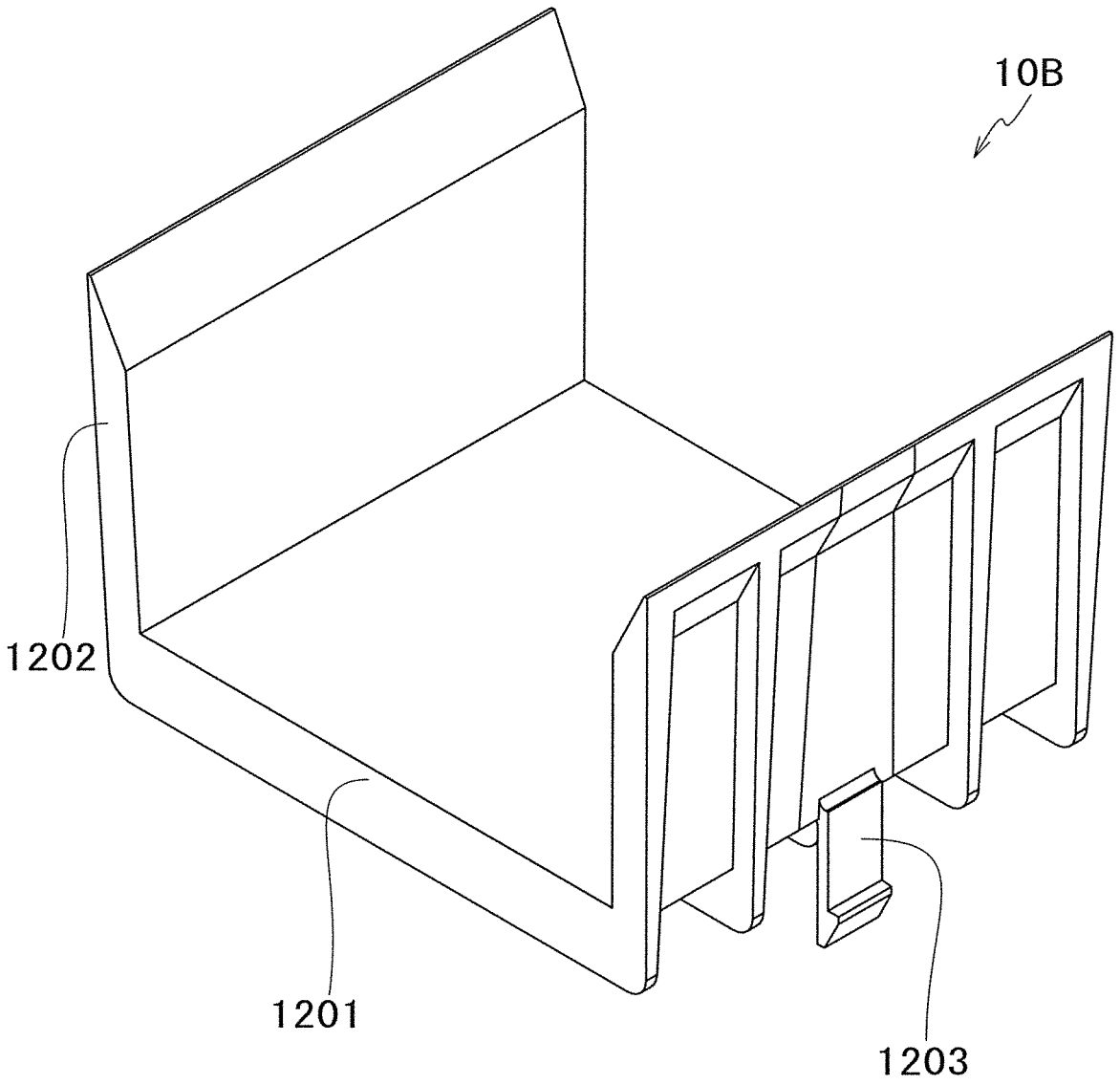
FIG. 5C is a perspective view of a spacer member.

Further, as shown in FIG. 5C, the spacer member 10B is formed in a substantial U-shape in a cross-sectional view for forming the space accommodating the game medium 8B. Similar to the spacer member 10A, the spacer member 10B includes a bottom surface portion 1201, side surface portions 1202, and hook portions 1203. The thickness of the bottom surface portion 1201 of is adjusted so that the center portion of each game medium 8B accommodated in the spacer member 10B is located at the distance 80 (see FIG. 5A) from the bottom surface of the accommodation case 9. As described above, the center portion of the game medium 8C accommodated in the accommodation portion 9*a* is located at the distance 80 (see FIG. 3A) from the bottom surface of the accommodation case 9 without the spacer member 10A or the spacer member 10B. Thus, the center portion (81 to 83) of any of the game media 8A to 8C is located at the same distance from the bottom surface of the accommodation case 9 when accommodated.

Thus, as for the outer shape of the game media 8, there are different types of game media 8 which are different in the size in a height direction of the game media 8 aligned in the horizontal direction. The accommodation case 9 includes the plurality of accommodation portions 9*a* each configured to accommodate the game media 8, and the spacer members 10 attachable/detachable with respect to these accommodation portions 9*a*. The spacer members 10 regulate the positions of the center portions of the game media 8 of relative to the antenna boards 11 in the reading region so that a predetermined positional relationship is satisfied, even when the game media 8 are of different types which are different in the size.

That is, when the game media of different sizes 8A to 8C are lined up in the horizontal direction to be accommodated in the tray mechanism 2, the center portions 81 to 83 of the game media 8A to 8C arranged in the horizontal direction can be set at the same height by the spacer members 10A and 10B. Thereby, even the game media are of different sizes, since the positional relationship of the antenna boards 11 and the game media 8A to 8C is constant, the reading mechanism 4 can read the game medium information of the game media 8A to 8C by radio communication more stably.

Further, the spacer member 10A, and the spacer member 10B are attached to the accommodation case 9 in a fixed state, by hooking the claw portions of the respective hook portion 1103 and hook portion 1023 to the fixing holes 92*b* (see FIG. 4C and FIG. 4D) of the accommodation case 9. Thus, when the game medium 8 is accommodated in the accommodation case 9 by using the spacer member 10, the game medium 8 can be supported stably.

Figure 5D:
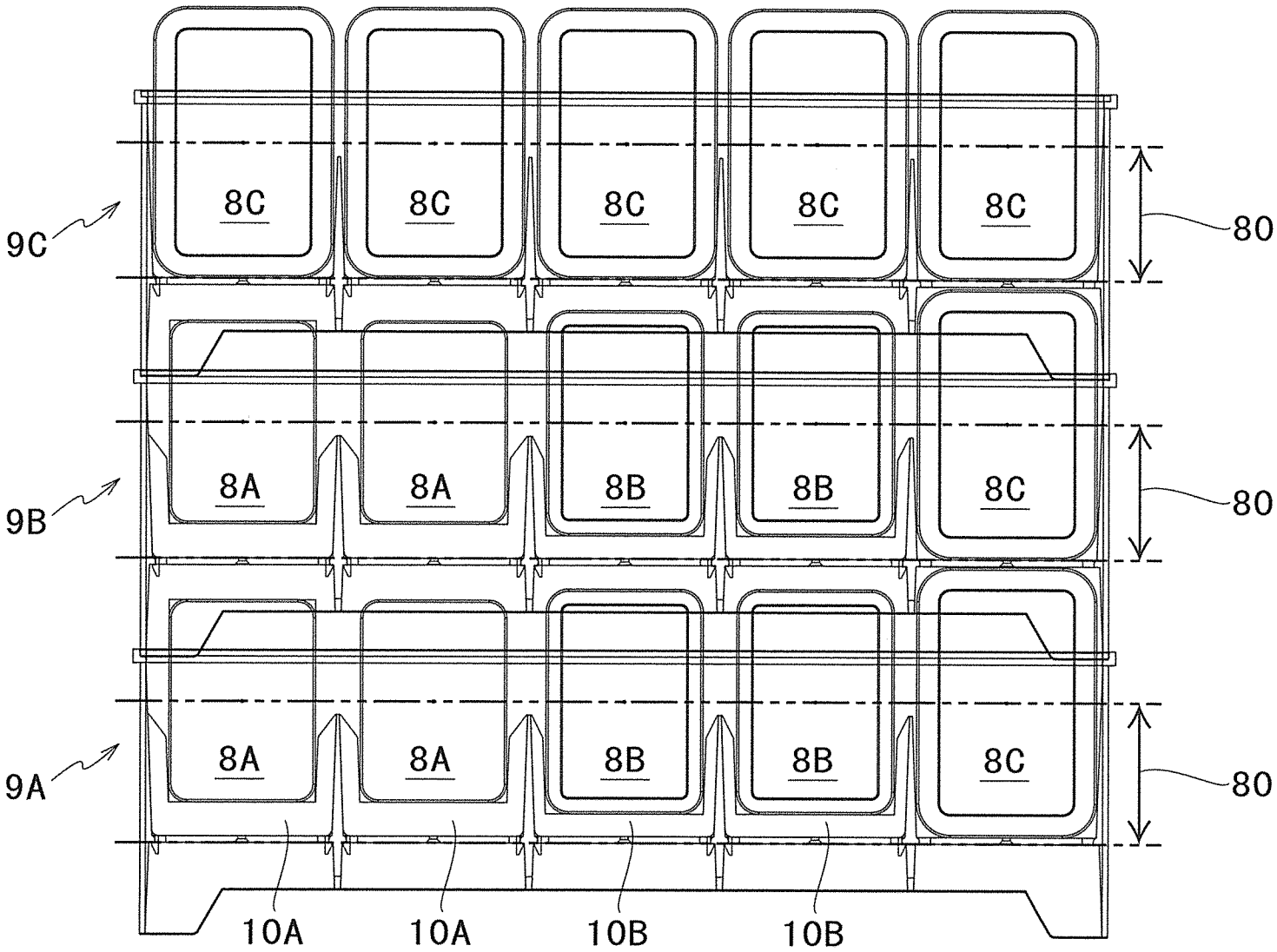
FIG. 5D is a partial perspective front view showing a state in which the accommodation cases are stacked.

With the configuration described above, as shown in FIG. 5D, the accommodation cases 9A to 9C, in each of which a plurality of bundles of the aligned media 8A to 8C are lined up in the horizontal direction, can be stacked in the up-down direction. Then, in such a stacking state, the height positions of the center portions of all types of the game media 8A to 8C in the accommodation case 9A of the lower stage are adapted to match the distance 80 from the bottom surface of the accommodation case 9A. Further, the height positions of the center portions of all types of the game media 8A to 8C in the accommodation case 9B of the middle stage are adapted to match the distance 80 from the bottom surface of the accommodation case 9B. Furthermore, the height positions of the center portions of the game media 8C in the accommodation case 9C of the upper stage are adapted to match the distance 80 from the bottom surface of the accommodation case 9A. Thus, even when any type of the game media 8A to 8C is accommodated in any of the accommodation portions 9*a* of the three accommodation cases 9A to 9C stacked in three stages, the center portion of the game medium accommodated in the accommodation case 9 is set at the same distance from the bottom surface of the accommodation case 9 by using the spacer 10A, 10B.

(Game Medium Accommodation Device 1: Tray Mechanism 2)

Figure 6A:
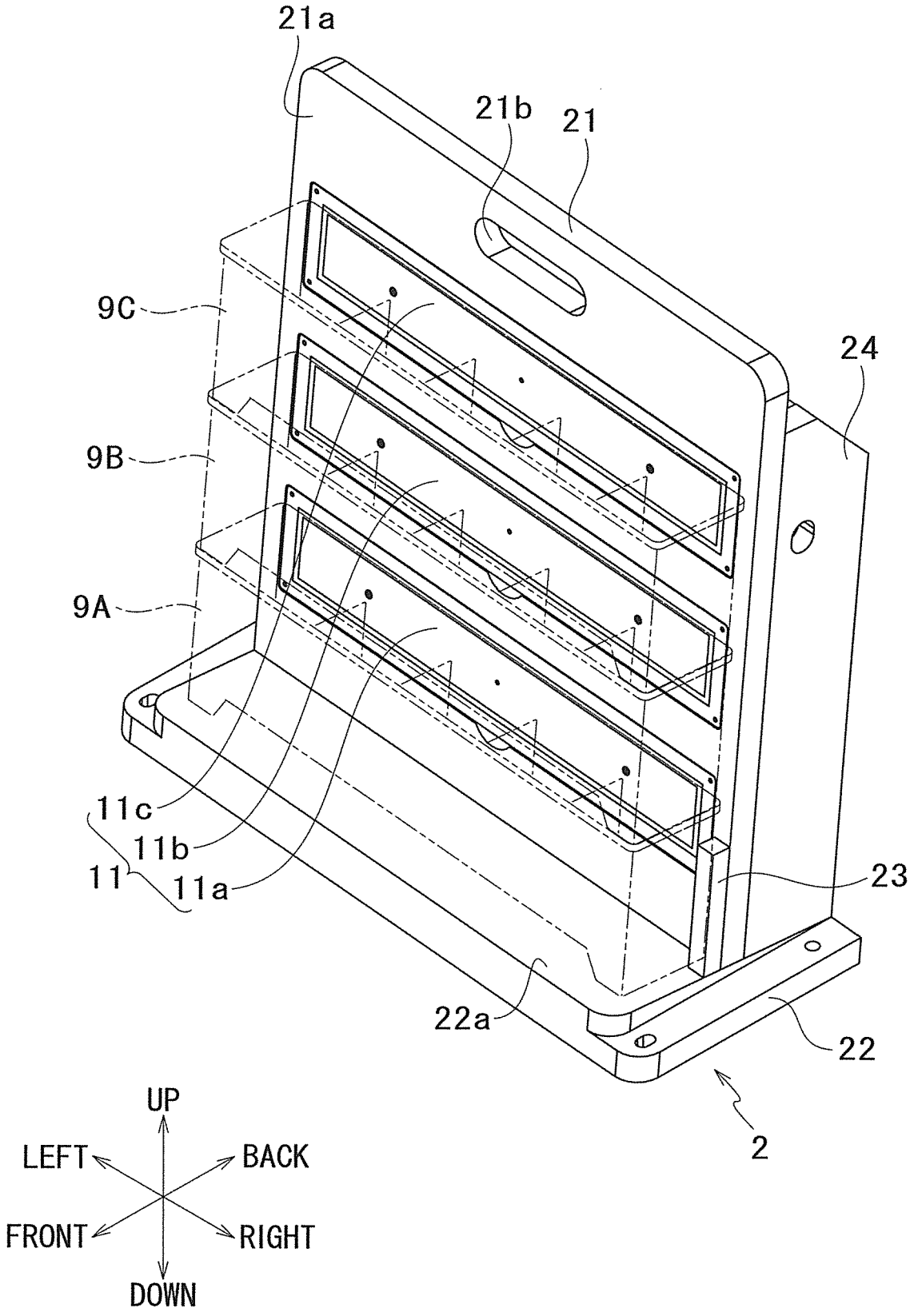
FIG. 6A is a perspective view of a tray mechanism.

As shown in FIG. 6A, the tray mechanism 2 is configured so that the three accommodation cases 9A to 9C stacked in the up-down direction are disposed in the tray mechanism 2. That is, 150 game media 8 can be arranged in the single tray mechanism 2. The tray mechanism 2 includes an arrangement plate 21, a pedestal portion 22, a guide portion 23, and a tuner accommodation portion 24.

The arrangement plate 21, the guide portion 23, and the tuner accommodation portion 24 are disposed to be supported by the placing surface 22*a* which is the upper surface of the pedestal portion 22 constituting the lower portion of the tray mechanism 2. The arrangement plate 21 is a flat plate-shaped member having a reading surface 21*a* and abutting against the rear sides of the three accommodation cases 9A to 9C stacked in the up-down direction. The arrangement plate 21 has a handle hole 21*b* penetrating the plate 21 in the front-back direction and being long in the left-right direction. The hole 21*b* is formed at the center of an upper portion of the reading surface 21*a*. The guide portion 23 is a rectangular parallelepiped member provided to be raised vertically from the placing surface 22*a* of the pedestal portion 22 along the right edge of the reading surface 21*a* from the lower right corner portion of the reading surface 21*a*. The tuner accommodation portion 24 is disposed on the rear surface of the arrangement plate 21, and accommodates, in its internal space, a coupler board 25 and a ferrite core 26 which will be described later.

Further, as shown in FIG. 6A, the space of the tray mechanism 2 facing the reading surface 21*a* is open. Then, a group of the stacked accommodation cases 9 is accommodated in the tray mechanism 2 in a state of being exposed to the outside. Thus, the stacked accommodation cases 9 are kept in a state where the cases 9 lean on the reading surface 21*a* and are along the reading surface 21*a*. Further, the space facing the reading surface 21*a* is open, i.e., the space is visible from the outside. Thus, handling of the bundles of the game media 8 in each accommodation case 9 is easy.

Figure 6B:
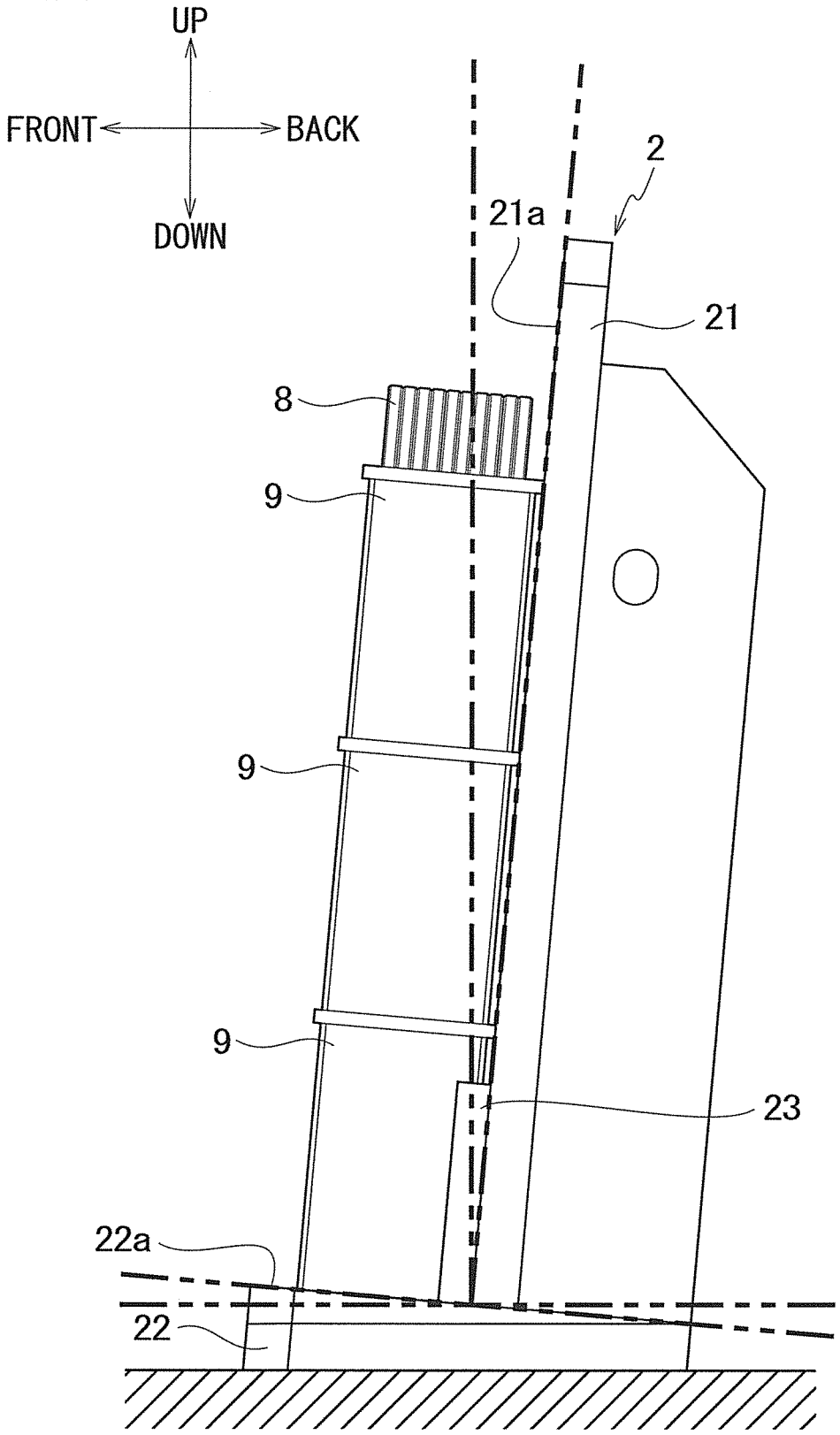
FIG. 6B is a side view of the tray mechanism.

As shown in FIG. 6B, the tray mechanism 2 is formed so that a line perpendicular to the reading surface 21*a* of the arrangement plate 21 declines toward the side of the tuner accommodation portion 24. Specifically, the placing surface 22*a* of the pedestal portion 22 is inclined in such a manner that the height of the rear edge is vertically lower than the height of the front edge. The reading surface 21*a* of the arrangement plate 21 is provided perpendicularly to such placing surface 22*a*. Accordingly, the reading surface 21*a* has such an inclination that the upper edge is at a position rearward from the lower edge.

When the three stacked accommodation cases 9A to 9C are disposed in the tray mechanism 2, the lower face of the stacked accommodation cases 9 is abutted against the placing surface 22*a* of the pedestal portion 22, and the rear surfaces of the stacked accommodation cases 9 are abutted against the reading surface 21*a* of the arrangement plate 21. That is, the accommodation cases 9A to 9C are supported by the arrangement plate 21 and the pedestal portion 22 in a state where the rear sides are abutted against the reading surface 21*a*, and the lower surface is abutted against the placing surface 22*a*. Thus, the positioning in the up-down direction and the front-back direction of the stacked three accommodation cases 9A to 9C is performed.

Furthermore, by moving the accommodation cases 9 which have been positioned in the up-down direction and the front-back direction toward the right, and abutting the right surface against the guide portion 23, the movement of the accommodation cases 9 toward the right is restricted, so that positioning of the accommodation cases 9 in the up-down direction, the front-back direction, and the left-right direction is performed. In this way, the tray mechanism 2 is formed to expose the accommodation cases 9 stacked along the reading surface 21*a* to the outside. Thereby, even when the bundles of the game media 8 are arranged in a matrix form in the horizontal direction and up-down direction by stacking the accommodation cases 9, a particular bundle of the game media 8 can be easily found out from the outside.

In this way, the accommodation cases 9 are placed on the placing surface 22*a* along the reading surface 21*a*. That is, the tray mechanism 2 forms the placing surface 22*a* for the accommodation cases 9 which surface extends from the reading surface 21*a* in the horizontal direction. Further, the placing surface 22*a* is formed in an inclined shape so that the plurality of the accommodation cases 9 can be stacked in the up-down direction along the reading surface 21*a*. Thus, when the accommodation cases 9 are stacked in the up-down direction along the reading surface 21*a*, since the placing surface 22*a* for placing the accommodation case 9 is in the inclined shape, the group of the accommodation cases 9 stacked in the up-down direction (vertical direction) leans against the reading surface 21*a*, to be supported by the placing surface 22*a* in a state along the reading surface 21*a*. Therefore, even when a number of the game media 8 accommodated in each accommodation portion 9*a* of the accommodation cases 9 is less than the maximum accommodation number, the risk that the game media 8 may fall to the side opposite to the side of the reading surface 21*a* by own weight can be reduced. As a result, the risk that the communication distance between the antenna boards 11 on the reading surface 21*a* side and the game media 8 increases to deteriorate the performance of the radio communication can be reduced.

Figure 6C:
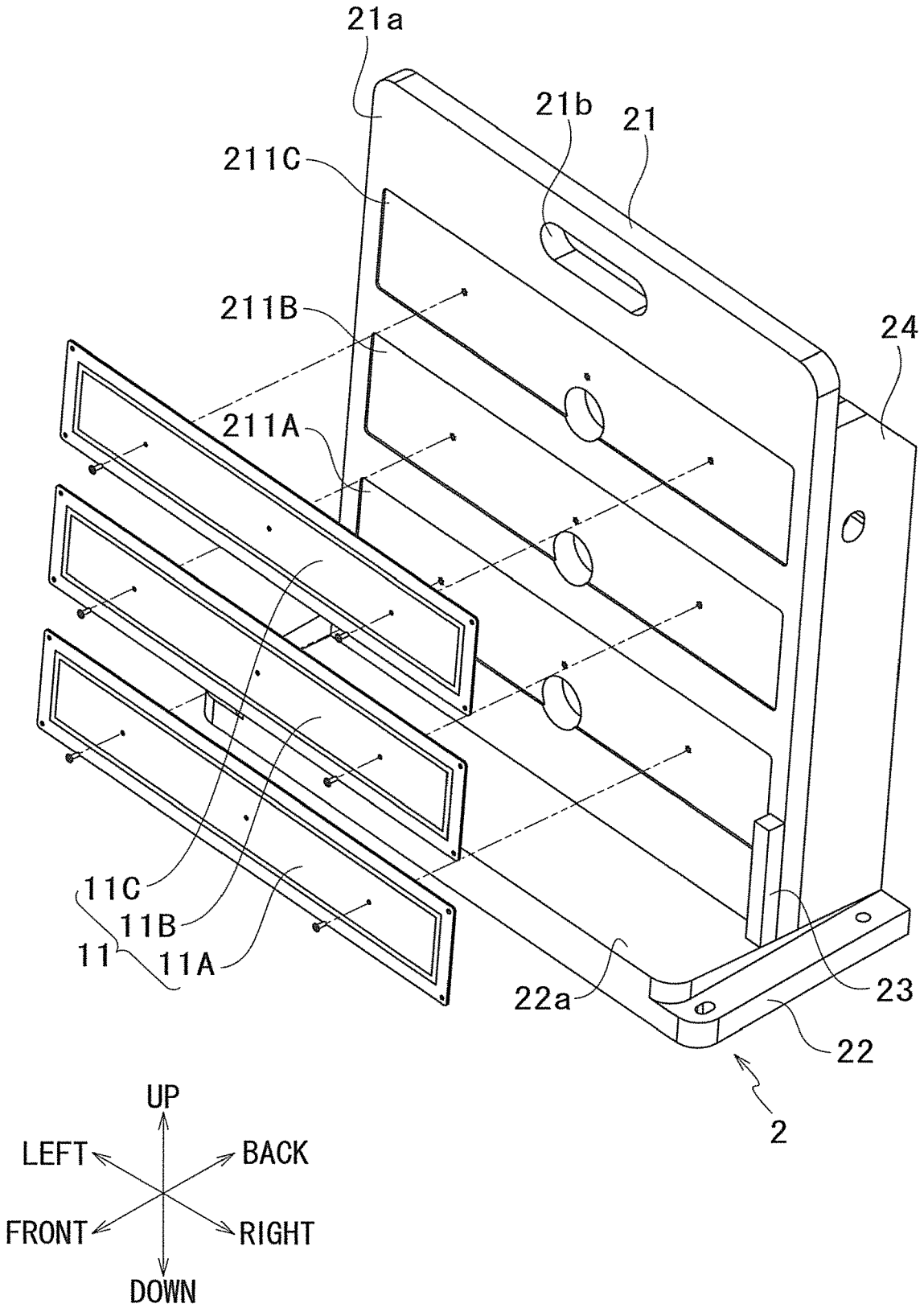
FIG. 6C is a partial exploded perspective view of the tray mechanism.

As shown in FIG. 6A and FIG. 6C, antenna boards 11A, 11B, and 11C are provided to the arrangement plate 21. The antenna boards 11A to 11C respectively receive the radio communication from the game media 8 accommodated in the three accommodation cases 9A to 9C stacked in the upper stage, the middle stage, and the lower stage respectively. That is, the antenna board 11A is capable of acquiring only the game medium information of the game media 8 accommodated in the accommodation case 9A in the lower stage by radio communication. Further, the antenna board 11B is capable of acquiring only the game medium information of the game media 8 accommodated in the accommodation case 9B in the middle stage by radio communication. Further, the antenna board 11C is capable of acquiring only the game medium information of the game media 8 accommodated in the accommodation case 9C in the upper stage by radio communication. In the following description, the antenna board 11A in the lower stage may be referred to as the first antenna, the antenna board 11B in the middle stage may be referred to as the second antenna, and the antenna board 11C in the upper stage may be referred to as the third antenna.

As shown in FIG. 6C, each of the antenna boards 11A to 11C has a flat plate shape which is long in the left-right direction, and the antenna boards 11A to 11C are disposed on the reading surface 21*a*. The antenna boards 11A to 11C are formed in the same shape. The arrangement plate 21 has recessed portions 211A, 211B, and 211C in the reading surface 21*a*. The recessed portions 211A to 211C are formed in a size and shape which enables the antenna boards 11A to 11C to be respectively fitted in the recessed portions 211A to 211C, and have a depth that matches the thickness of the antenna boards 11A to 11C. Thus, the antenna boards 11A to 11C are embedded in the reading surface 21*a* so as to be flush with the reading surface 21*a*.

The recessed portions 211A to 211C are disposed so as to face the accommodation cases 9A to 9C respectively, in a state where the stacked three accommodation cases 9A to 9C are disposed in the tray mechanism 2. Thus, it is possible to dispose the antenna boards 11A to 11C, with high accuracy, so as to face the accommodation cases 9A to 9C, by only performing an operation of fitting the antenna boards 11A to 11C in the antenna boards 11A to 11C. The antenna boards 11A to 11C are fixed in the recessed portions 211A to 211C by screws respectively.

Penetrating round holes 212A, 212B, and 212C are formed in the recessed portions 211A to 211C, respectively. A part of each hole 212A, 212B, 212C is formed in the reading surface 21. The holes 212A, 212B, and 212C are set to have a diameter which enables a finger to be inserted therein. The holes 212A, 212B, and 212C allow the manual operation with a finger to be performed easily when fixing the antenna boards 11A to 11C into the recessed portions 211A to 211C, or removing the antenna boards 11A to 11C from the recessed portions 211A to 211C.

Figure 6D:
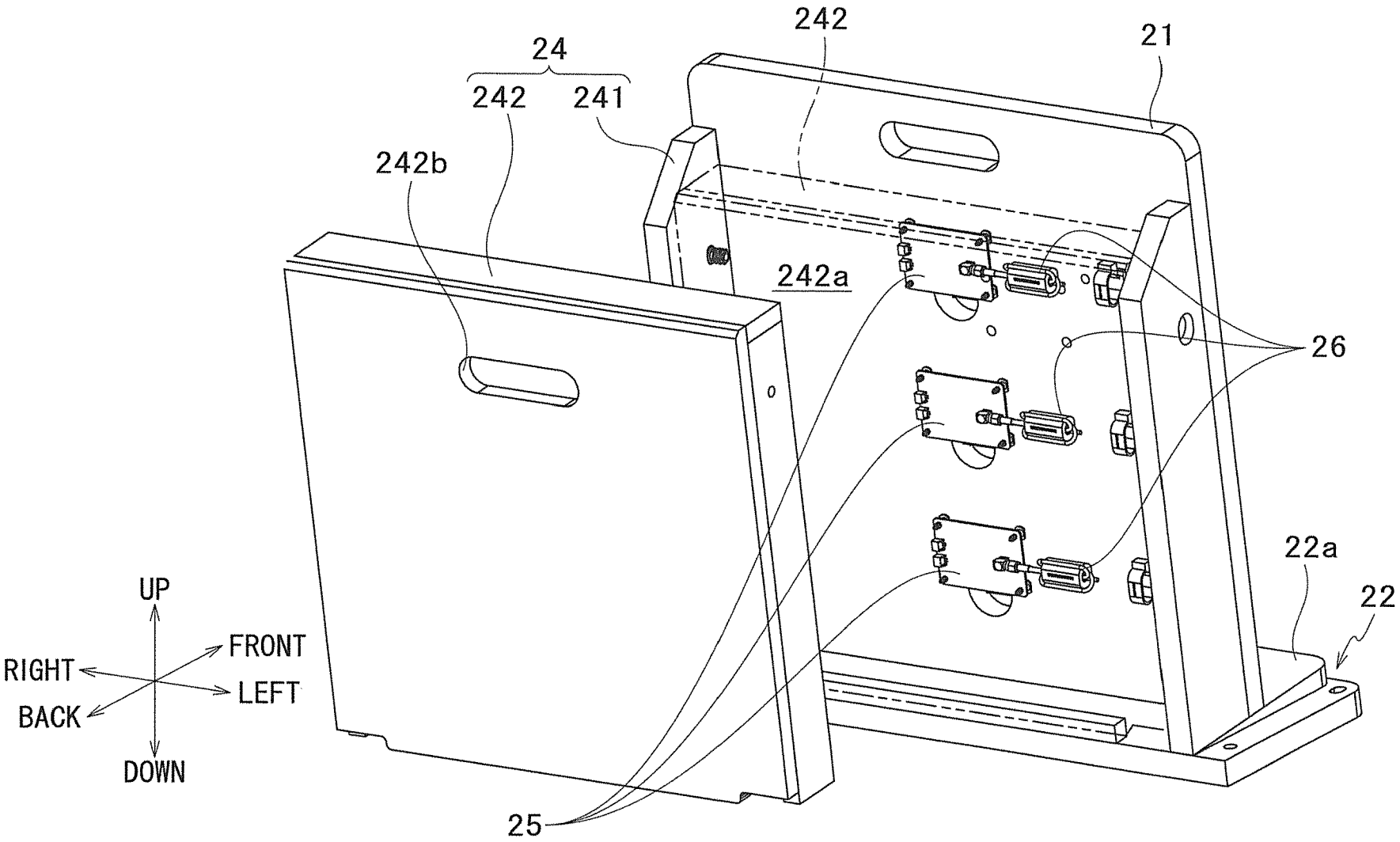
FIG. 6D is a partial exploded perspective view of the tray mechanism.

As shown in FIG. 6D, the tuner accommodation portion 24 includes a support portion 241 and a frame body 242. The support portion 241 is provided to the surface on the opposite side of the reading surface 21*a* of the arrangement plate 21, and is provided along the side edges of the arrangement plate 21 to be raised from the placing surface 22*a* of the pedestal portion 22. The frame body 242 is a box-shaped member formed in a rectangular parallelepiped shape in which one side is opened, and has an accommodation space 242*a* therein. The frame body 242 is fixed by screws to the support portion 241 in a state where the reading mechanism 4 is accommodated in the accommodation space 242*a*. The reading mechanism 4 is provided on the surface on the opposite side of the reading surface 21*a* of the arrangement plate 21.

Coupler boards 25 each having an antenna tuner for reducing the loss of radio wave, and ferrite cores 26 for reducing high-frequency noise are provided on the arrangement plate 21 side in the accommodation space 242*a*. The coupler boards 25 and the ferrite cores 26 are provided at three positions corresponding to the antenna boards 11A to 11C (see FIG. 6A and FIG. 6C). The coupler boards 25 are connected to the antenna boards 11A to 11C respectively. A signal line connecting each coupler board 25 and the information acquiring mechanism 40 is inserted into the corresponding ferrite core 26. The ferrite core 26 reduces the noise mixed in the signal line between the information acquiring mechanism 40 and the coupler board 25.

Further, the frame body 242 has a handle hole 242*b* penetrating an upper portion of the frame body 242. The handle hole 242*b* allows the manual operation to be performed easily when fixing or removing the frame body 242 of the tuner accommodation portion 24 with respect to the tray mechanism 2. Further, when the accommodation space 242*a* is closed by attaching the frame body 242 to the tray mechanism 2, an air hole communicating the accommodation space 242*a* with the outside is formed. Thus, in the game medium accommodation device 1, an air passage within the accommodation space 242*a* is secured, to prevent malfunction due to an excessive temperature rise caused by the coupler boards 25 and the ferrite cores 26 provided in the accommodation space 242*a*.

(Positional Relationship Between Antenna Boards 11 and Game Media 8)

Figure 7:
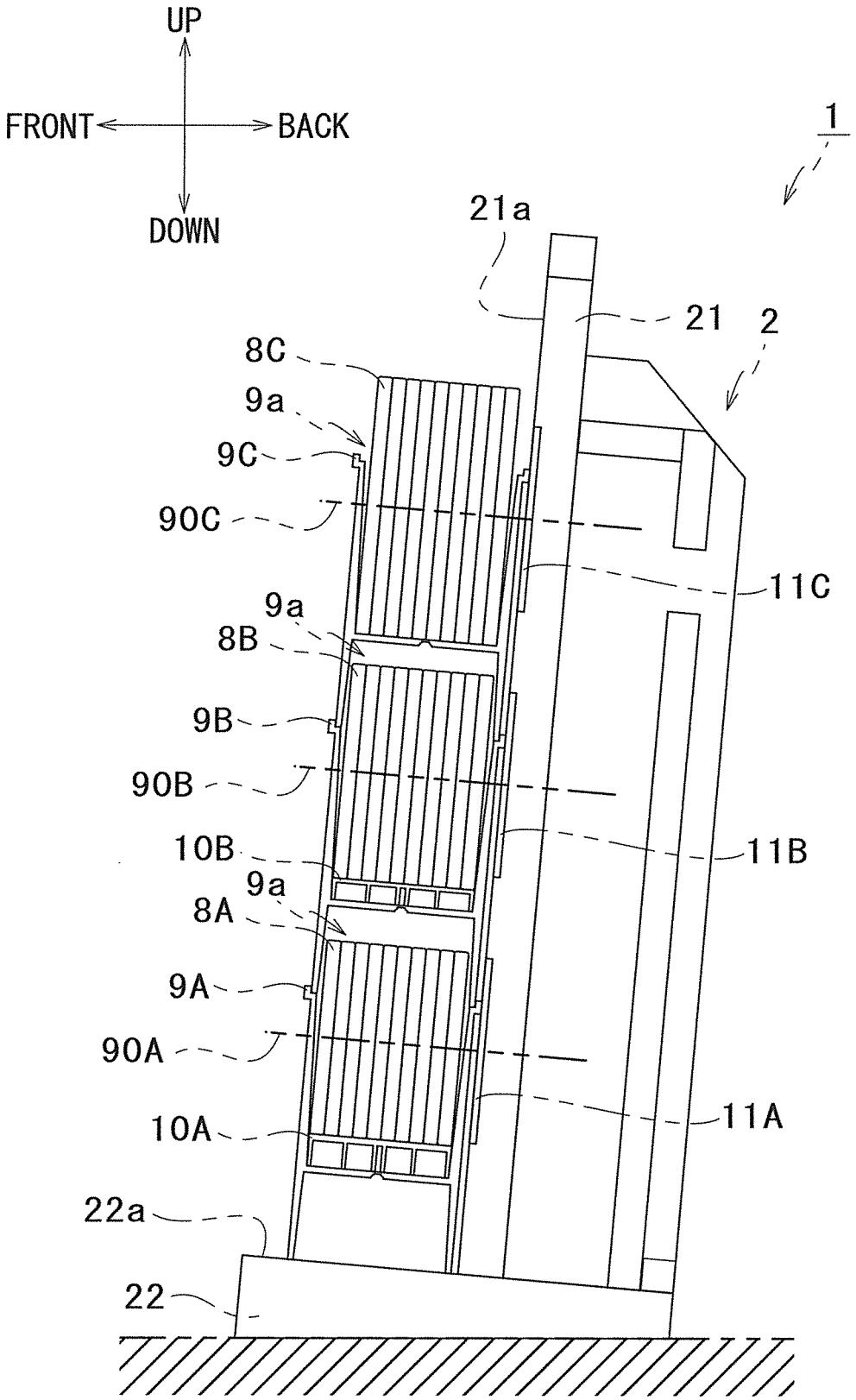
FIG. 7 is an explanatory drawing showing a positional relationship of game media and antenna boards.

The following will describe the positional relationship between the antenna boards 11 and the game media 8 in the situation where the accommodation cases 9A to 9C, each accommodating bundles of the aligned game media 8 lined up in the horizontal direction, are stacked in the up-down direction along the reading surface 21*a* in the tray mechanism 2, with reference to FIG. 7.

As shown in FIG. 7, in the tray mechanism 2, the accommodation case 9B is stacked on the accommodation case 9A, and the accommodation case 9C is stacked on the accommodation case 9B. In each accommodation case 9, the bundles of the aligned game media 8 are accommodated. As described above, in the tray mechanism 2, the accommodation cases 9 are disposed so that the stacking direction is inclined to be parallel to the reading surface 21*a* of the arrangement plate 21. Meanwhile, the alignment direction of each bundle of the game media 8 in each accommodation case 9 is inclined to match the inclination of the placing surface 22*a* of the pedestal portion 22.

In the accommodation cases 9A to 9C, the spacer 10A is attached to the accommodation portion 9*a* accommodating the game media 8A, and the spacer 10B is attached to the accommodation portion 9*a* accommodating the game media 8B. Thereby, in the stacking direction of the accommodation cases 9, the center portion of each game medium 8 is set at the same distance from the bottom surface. That is, the center portions of the game media 8 accommodated in the accommodation portion 9*a* of the same accommodation case 9 are positioned on the same straight line of which inclination angle matches the inclination angle of the placing surface 22*a*.

That is, as shown in FIG. 7, the center portions of the game media 8 accommodated in the same accommodation portion 9*a* in the accommodation case 9A are arranged on the same straight line 90A, the center portions of the game media 8 accommodated in the same accommodation portion 9*a* in the accommodation case 9B are arranged on the same straight line 90B, and the center portions of the game media 8 accommodated in the same accommodation portion 9*a* in the accommodation case 9C are arranged on the same straight line 90C. Further, the positions of the antenna boards 11A to 11C are set on the reading surface 21*a* so that the antenna boards 11A to 11C are respectively disposed on these straight lines 90A to 90C. That is, the antenna board 11A is disposed to face the center portions of the game media 8 of each accommodation portion 9*a* in the accommodation case 9A, the antenna board 11B is disposed to face the center portions of the game media 8 of each accommodation portion 9*a* in the accommodation case 9B, and the antenna board 11C is disposed to face the center portions of the game media 8 of each accommodation portion 9*a* in the accommodation case 9C.

In this way, the bundles of the game media 8 are arranged in a matrix form of M rows and N columns by using the accommodation cases 9. Further, by positioning the accommodation case 9 in the tray mechanism 2, reading regions of the antenna boards 11 are set to correspond to the rows of the bundles of the game media 8 arranged in a matrix form. That is, the game media 8 accommodated in the accommodation cases 9 are read by the respective antenna boards 11. i.e., the antenna boards 11 respectively correspond to the accommodation cases 9.

In addition, the accommodation cases 9 are positioned in the tray mechanism 2, and further the center portions of the game media 8 are set at the same height with the use of the spacer members 10. With this, the center portions of the game media 8 relative to the reading regions of the antenna boards 11 are set at the same height. Thereby, the reading mechanism 4 can read the electronic information of the game media 8 by radio communication more stably.

(Game Medium Accommodation Device 1: Reading Mechanism 4)

Figure 8:
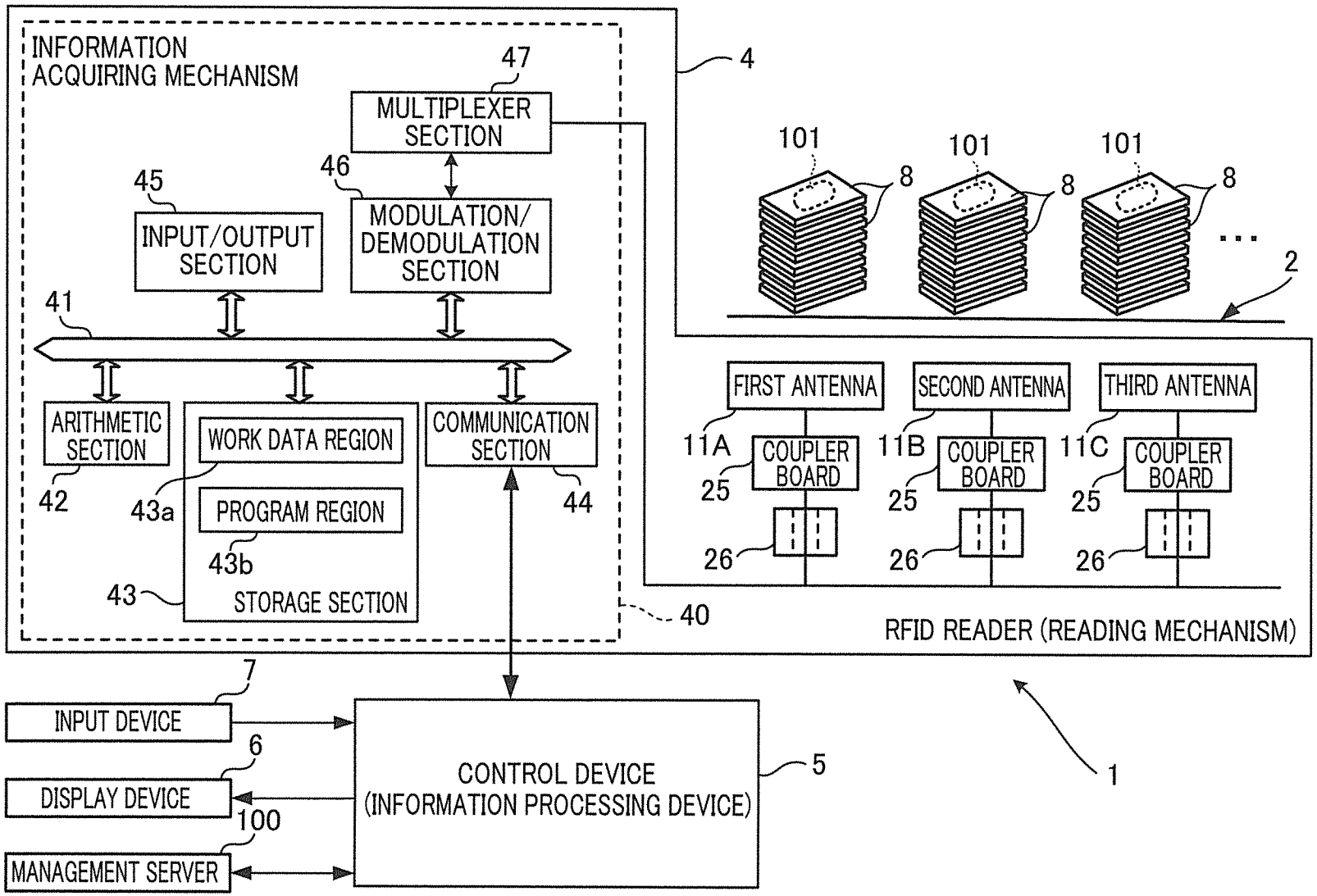
FIG. 8 is an explanatory drawing showing an electrical configuration of the game medium accommodation device.

As shown in FIG. 8, the reading mechanism 4 is configured by an RFID reader including the antenna boards 11 and the information acquiring mechanism 40. In the reading mechanism 4, the antenna boards 11 (the first to the third antennas) are connected to the information acquiring mechanism 40 via the coupler boards 25. The signal lines connecting the information acquiring mechanism 40 and the coupler boards 25 are inserted into the ferrite cores 26 respectively. Thus, the antenna boards 11 are disposed on the reading surface 21*a* of the tray mechanism 2. The reading mechanism 4 is configured to acquire the game medium information including the game values of the game media 8 arranged in the tray mechanism 2.

Specifically, the information acquiring mechanism 4 has an arithmetic section 42, a storage section 43, a communication section 44, an input/output section 45, and a modulation/demodulation section 46 connected to allow various data to be input and output bidirectionally via a signal bus 41. The input/output section 45 is configured to be connected to various sensors, operation buttons, and/or driving mechanisms which are not shown in the figure. The communication section 44 is connected to the control device 5 to allow data communication. The modulation/demodulation section 46 is connected to the antenna boards 11A to 11C of the tray mechanism 2 via a multiplexer section 47. The multiplexer section 47 has a switch circuit, and connects the modulation/demodulation section 46 with the antenna boards 11A to 11C switchably.

The modulation/demodulation section 46 has a modulation function of converting data from a signal form suitable for information processing to a signal form suitable for data communication via the antenna boards 11A to 11C, and has a demodulation function of converting data from the signal form of data communication to the signal form of information processing.

Further, the storage section 43 has a work data region 43*a* and a program region 43*b*. The work data region 43*a* is used, for example, as a game medium management database temporarily storing the game medium information acquired from the game media 8.

As shown in FIG. 9, the game medium management database stores the identification information of the game media 8 (RFID tag 101) and the group code. In the present embodiment, the identification information of the game media 8 is a 64-bit UID (Unique IDentifier) of the RFID tag 101. The group code is an 8-bit AFI (Application Family Identifier) of the RFID tag 101. Further, in the game medium management database 35 of the present embodiment, a DSFID (Data Storage Format Identifier) may be stored. The reading mechanism 4 reads data from the plurality of game media 8 by a stochastic method of RFID technology. Accordingly, the reading mechanism 4 is unnecessary to compare the intrinsic identification information of the game media 8 when recognizing the game media 8 by a first error detecting code and a second error detecting code.

The program region 43*b* stores various programs such as a reading process routine for reading the game medium information from the game media 8. The various programs such as the reading process routine can be executed in the arithmetic section 42. The reading process routine is configured to read the game medium information of the game media 8 in the unit of each accommodation portion 9*a* of each of the accommodation cases 9 stacked in the tray mechanism 2. Thus, as compared with the case where the game medium information of all the game media 8 arranged in accommodation portions 9*a* are read collectively, the time required for check read, reread or the like is reduced since the information is read individually for each portion, and therefore the game medium information can be read in a short time. The reading process of the game medium information including check read will be detailed later.

(Game Medium Accommodation Device 1: Control Device 5)

The control device 5 is constituted by an information processing device such as a personal computer. The control device 5 is connected to a display device 6 and an input device 7. Further, the control device 5 is connected data-communicably to a management server 100 via a communication line or a communication network. The management server 100 is adapted to perform an operation status management of the game medium accommodation device 1 and a comprehensive management of the game media 8.

The control device 5 has a storage section for storing data in a storage form of various data tables such as the game medium information table of FIG. 10.

(Game Medium Accommodation Device 1: Control Device 5: Game Medium Information Table)

As shown in FIG. 10, the game medium information table is a data table for storing the game medium information of various types of game media 8 arranged in the tray mechanism 2. Specifically, the game medium information table includes an identification information column, an attribute column, an amount column, and a denomination column, to store the game medium information of all the game media 8 accommodated in accommodation case 9 disposed in the tray mechanism 2.

For example, an identification information "ID501", an attribute "junket cash", an amount "100", and a denomination "HKD (Hong Kong dollar)" are stored in the first row. This indicates that a game medium 8 with identification information "ID501" having a game value of 100 HKD is present in the tray mechanism 2. Further, an identification information "ID721", an attribute "junket cash", an amount "100", and a denomination "HKD (Hong Kong dollar)" are stored in the sixth row. This indicates that a game medium 8 with identification information "ID721" having a game value of 100 HKD is present in the tray mechanism 2.

As the attributes, there are "cash", "junket cash", "junket NN (non-negotiable)", "premium cash", "premium NN (non-negotiable)" and the like. Here, "cash" refers to a convertible game medium issued to a player by the game place side. "Junket cash" refers to a convertible game medium issued to a player by the junket side. "Junket NN" refers to an inconvertible game medium issued to the player by the junket side. "Premium cash" refers to a convertible game medium issued to an important player by the game place side. "Premium NN" refers to an inconvertible game medium issued to an important player by the game place side.

(Game Medium Accommodation Device: Display State of Display Device 6)

Figure 11:
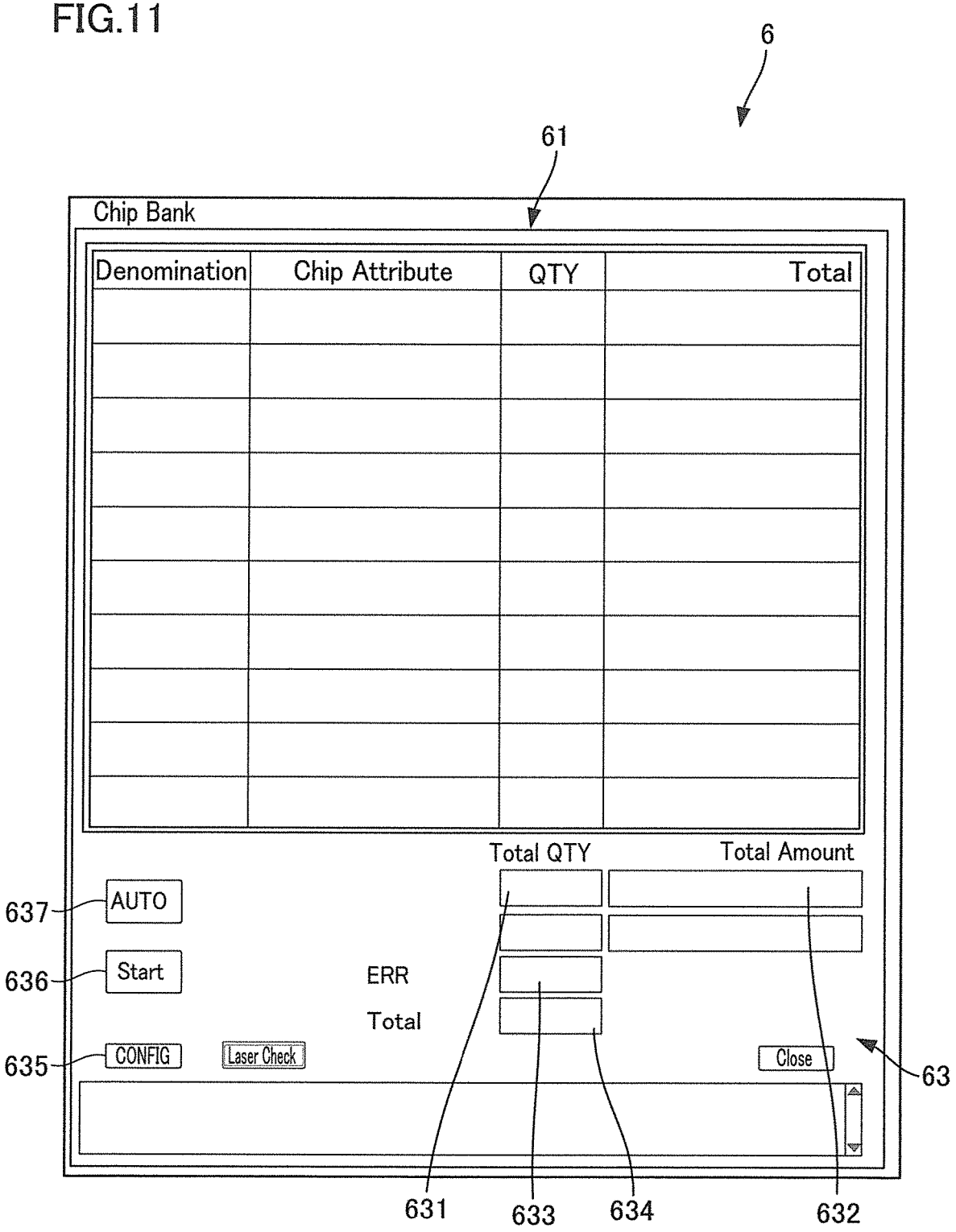
FIG. 11 is an explanatory drawing showing a display state of a display device.

As shown in FIG. 11, the display device 6 is configured to display a chip bank screen including an upper display section 61 arranged in an upper portion of the screen, and a lower display section 63 arranged below the upper display section 61.

In the upper portion of the upper display section 61, display items of the denomination and amount of the game media 8 ("Denomination"), the attribute of the game media 8 ("Chip Attribute"), the quantity of the game media 8 ("QTY"), and the amount obtained by multiplying the denomination and the quantity ("Total") are arranged horizontally, and the game medium information of all the game media 8 arranged in the tray mechanism 2 is displayed below these display items.

In the lower display section 63 below the upper display section 61, a denomination quantity section 631, a denomination amount section 632, an error section 633, and a total quantity section 634 are provided. The denomination quantity section 631 displays the quantity for each denomination of the game media 8 arranged in the tray mechanism 2. The denomination amount section 632 displays the total amount for each denomination of the game media 8 arranged in the tray mechanism 2. The error section 633 displays the quantity of error game media having ineligible game medium information as a game medium 8. The total quantity section 634 displays the quantity of all the game media arranged in the tray mechanism 2.

Further, in the lower display section 63, a CONFIG button 635, a start button 636, and an AUTO button 637 are provided. The CONFIG button 635 allows shifting to the CONFIG screen to perform the initial setting. The start button 636 is a button for performing the instruction of starting the acquisition of game medium information in the manual mode. The AUTO button 637 is a toggle switch for shifting the operating mode between the manual mode and the automatic mode. In the automatic mode, the latest game medium information in the tray mechanism 2 is acquired at a predetermined time interval.

A display example on the display device 6 when the game media 8 are arranged in the tray mechanism 2 will be described with reference to FIG. 12. In this example, one piece of "cash" with a denomination of "PHP (Philippine peso)" and an amount of "10"; one piece of "cash" with a denomination of "PHP" and an amount of "50"; one piece of "premium NN" with a denomination of "PHP" and an amount of "100"; one piece of "junket NN" with a denomination of "PHP" and an amount of "1000"; one hundred pieces of "cash" with a denomination of "HKD (Hong Kong dollar)" and an amount of "5"; one piece of "cash" with a denomination of "HKD" and an amount of "100"; one piece of "junket cash" with a denomination of "HKD" and an amount of "500"; five pieces of "premium cash" with a denomination of "HKD" and an amount of "500"; and one piece of error game medium are arranged in the tray mechanism 2.

Figure 12:
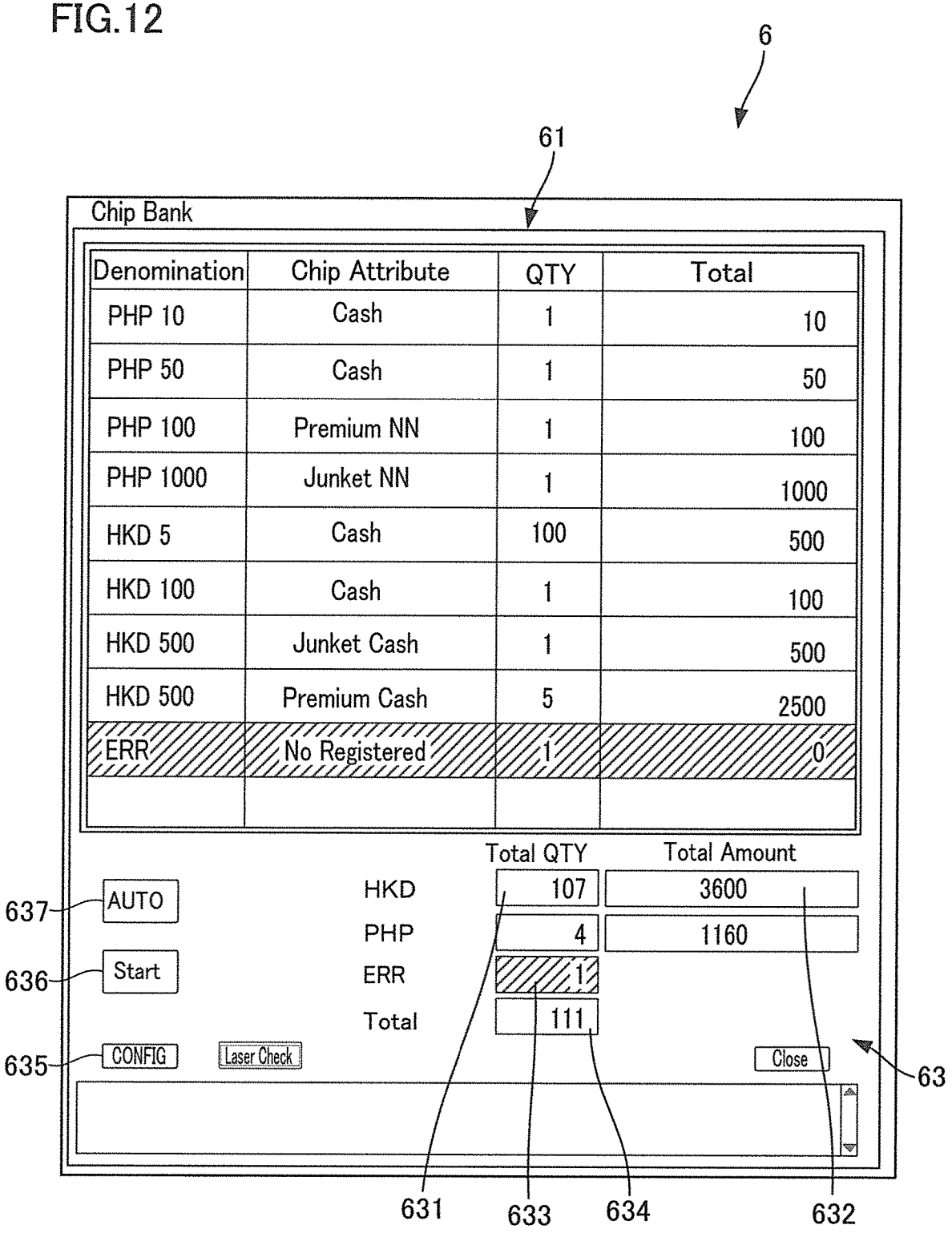
FIG. 12 is an explanatory drawing showing a display state of the display device.

In this case, as shown in FIG. 12, (i) the quantity and (ii) the total amount obtained by multiplying the quantity and the amount are displayed in the upper display section 61 for every denomination, amount and attribute. That is, if there are items which are the same in the denomination and the amount but different in the attribute, these are displayed in different rows. Further, with respect to the error game medium, "ERR" is displayed in the "Denomination" column, "No Registered" is displayed in the "Chip Attribute" column, "1" is displayed in the "QTY" column, and "0" is displayed in the "Total" column. In other words, there is indicated that there is one piece of the ineligible error game medium which is not added to the total amount.

Furthermore, in the lower display section 63, a total quantity "107" of denomination "HKD", and a total quantity "4" of denomination "PHP" are shown in the denomination quantity section 631. In addition, a total amount "3600" of denomination "HKD", and a total amount "1160" of denomination "PHP" are shown in the denomination amount section 632. Further, a total quantity "1" of the ineligible error game medium is shown in the error section 633. Further, "111" which is the total quantity of all the game media except for the error game medium arranged in the tray mechanism 2 is displayed in the total quantity section 634.

Incidentally, if an error game medium is arranged in the tray mechanism 2, the background color of the region corresponding to all the cells in the row of the error game medium in the upper display section 61 and the background color of the region of the error section 633 are changed (for example, into red). Thereby, the fact that the error game medium is arranged can be recognized at a glance.

In this way, the control device 5 obtains the total value of the game value for each type of the game media 8 based on the electronic information read by the reading mechanism 4, and the display device 6 displays these total values in association with the type of the game media 8. Thus, the type(s) and the total value(s) of the game media 8 accommodated in the game medium accommodation device 1 can be visually checked immediately.

(Operation of Game Medium Accommodation Device 1)

The operation of the game medium accommodation device 1 configured as the above will be described based on the flowchart. The following description will be given on the assumption that the game medium accommodation device 1 is powered on.

(Game Medium Accommodation Device: Control Device 5: Main Process)

Figure 13:
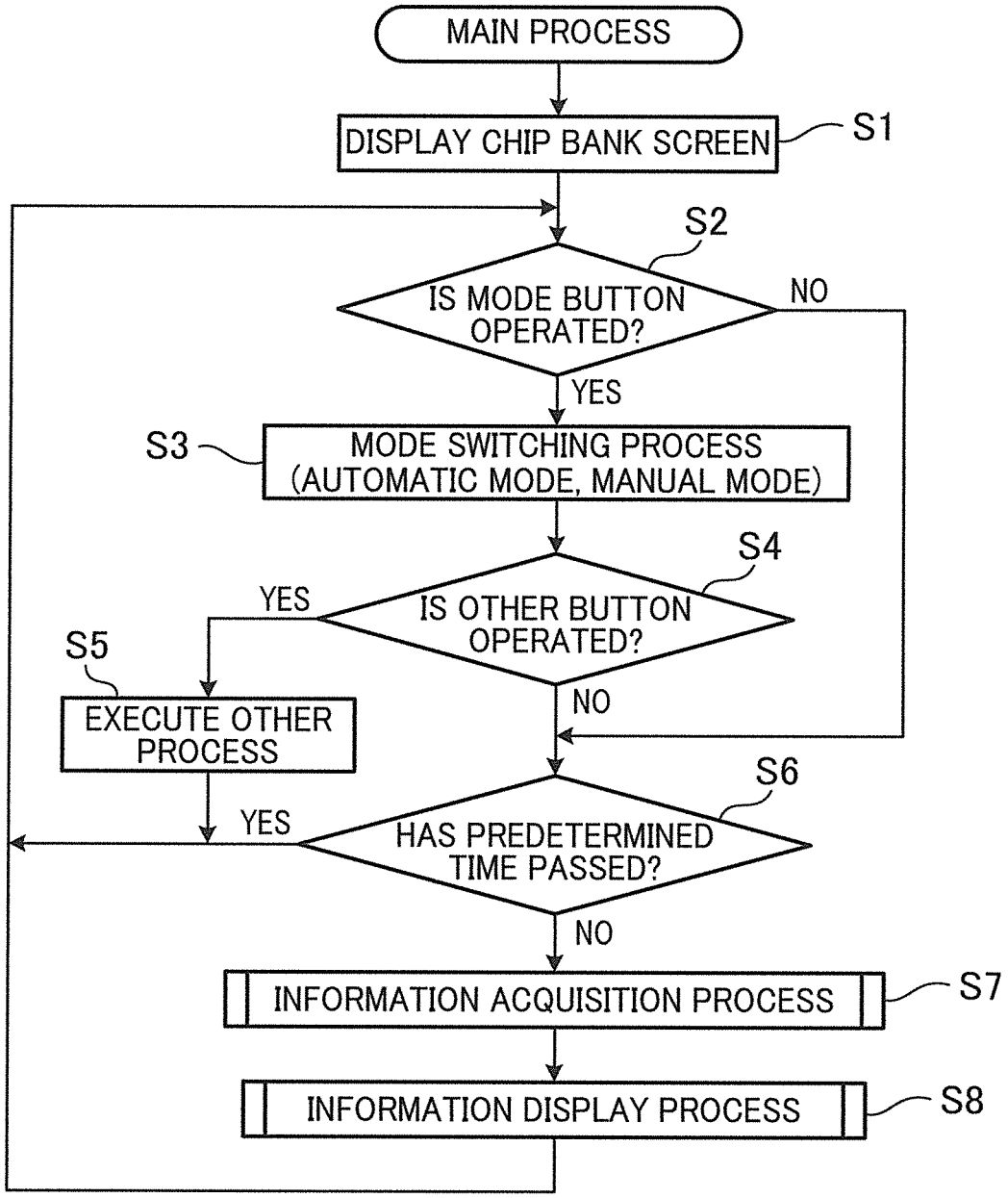
FIG. 13 is a flowchart of a main process.

As shown in FIG. 13, in the control device 5, various processes are executed by the main process routine. Specifically, first, a chip bank screen as shown in FIG. 11 is displayed (S1). Then, whether or not the AUTO button 637 in the cashier screen has been operated is determined (S2). If the AUTO button 637 is not operated (S2: NO), whether or not a predetermined time has passed as the standby time for the button operation is determined (S3). On the other hand, if the AUTO button 637 has been operated (S2: YES), a mode switching process is executed, and the mode is switched between the automatic mode and the manual mode. That is, if the operation is in the automatic mode, the mode is switched to the manual mode. If the operation is in the manual mode, the mode is switched to the automatic mode (S3).

Then, whether or not another button has been operated is determined (S4). If another button has been operated (S4: YES), after the process corresponding to the function of the operated button is executed (S5), re-execution from S2 is performed. On the other hand, if another button is not operated (S4: NO), whether or not a predetermined time has passed as the standby time for the button operation is determined (S6). If the predetermined time has not passed (S6: NO), re-execution from S2 is performed. On the other hand, if the predetermined time has passed (S6: YES), an information acquisition process for acquiring the game medium information from the reading mechanism 4 is executed (S7). Thereafter, an information display process for updating the chip bank screen (see FIG. 11 and FIG. 12) is executed based on the acquired game medium information (S8).

(Game Medium Accommodation Device 1: Control Device 5: Information Acquisition Process)

Figure 14:
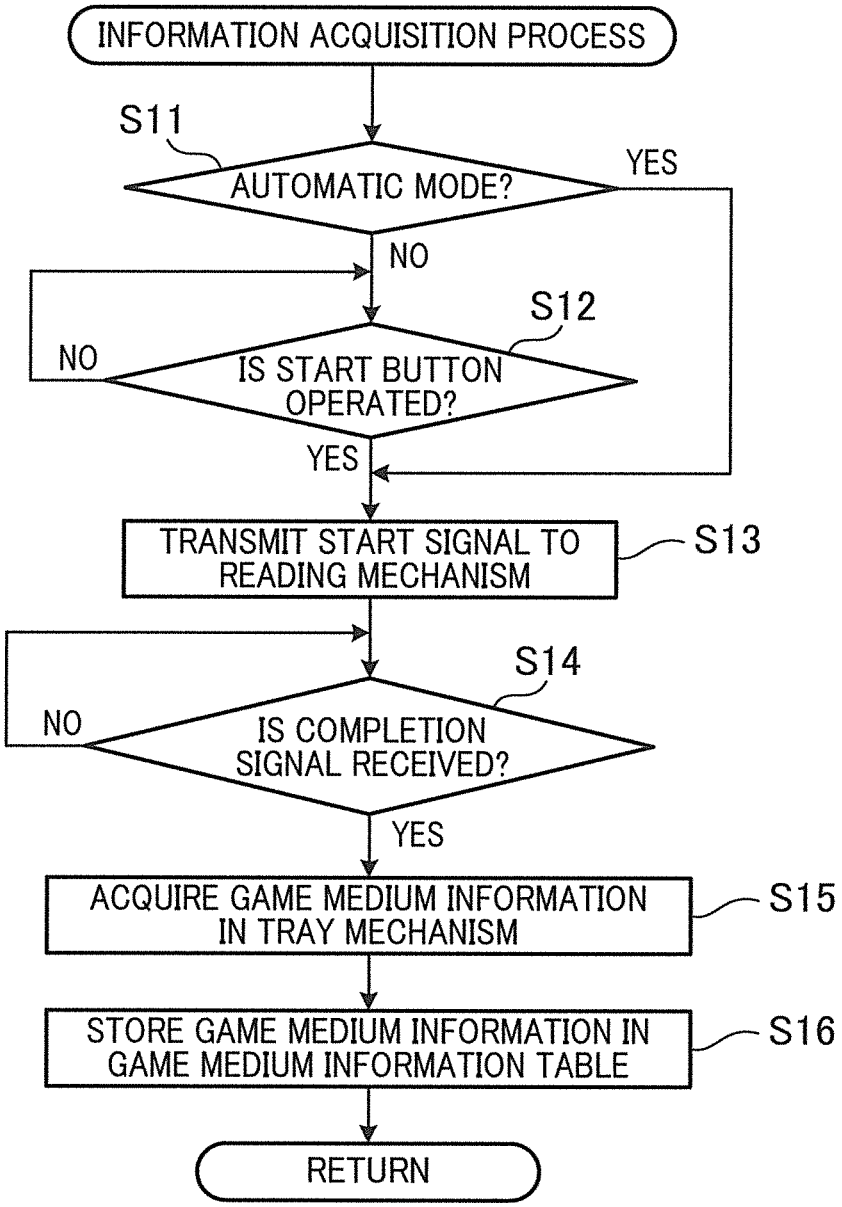
FIG. 14 is a flowchart of an information acquisition process.

As shown in FIG. 14, when the information acquisition process is executed in the main process, first, whether or not the mode is the automatic mode is determined (S11). If the mode is the automatic mode (S11: YES), a start signal is transmitted to the reading mechanism 4 (S13). On the other hand, if the mode is not the automatic mode (S11: NO), whether or not the start button 636 has been operated is determined (S12). If the start button 636 is not operated (S12: NO), S12 is executed again, and the device is in the standby state until the start button 636 is operated. If the start button 636 has been operated (S12: YES), the start signal is transmitted to the reading mechanism 4 (S13).

Thereafter, whether or not a completion signal has been received from the reading mechanism 4 is determined (S14). Here, the completion signal is a signal indicating that the game medium information of all the game media 8 arranged in the tray mechanism 2 has been read by the reading mechanism 4. If the completion signal is not received (S14: NO), S14 is executed again, and the device is in the standby state until the completion signal is received. If the completion signal has been received (S14: YES), the game medium information in the tray mechanism 2 is acquired from the reading mechanism 4 (S15). Then, the acquired game medium information is stored in the game medium information table as shown in FIG. 10 (S16), and the present routine is completed.

(Game Medium Accommodation Device 1: Control Device 5: Information Display Process)

Figure 15:
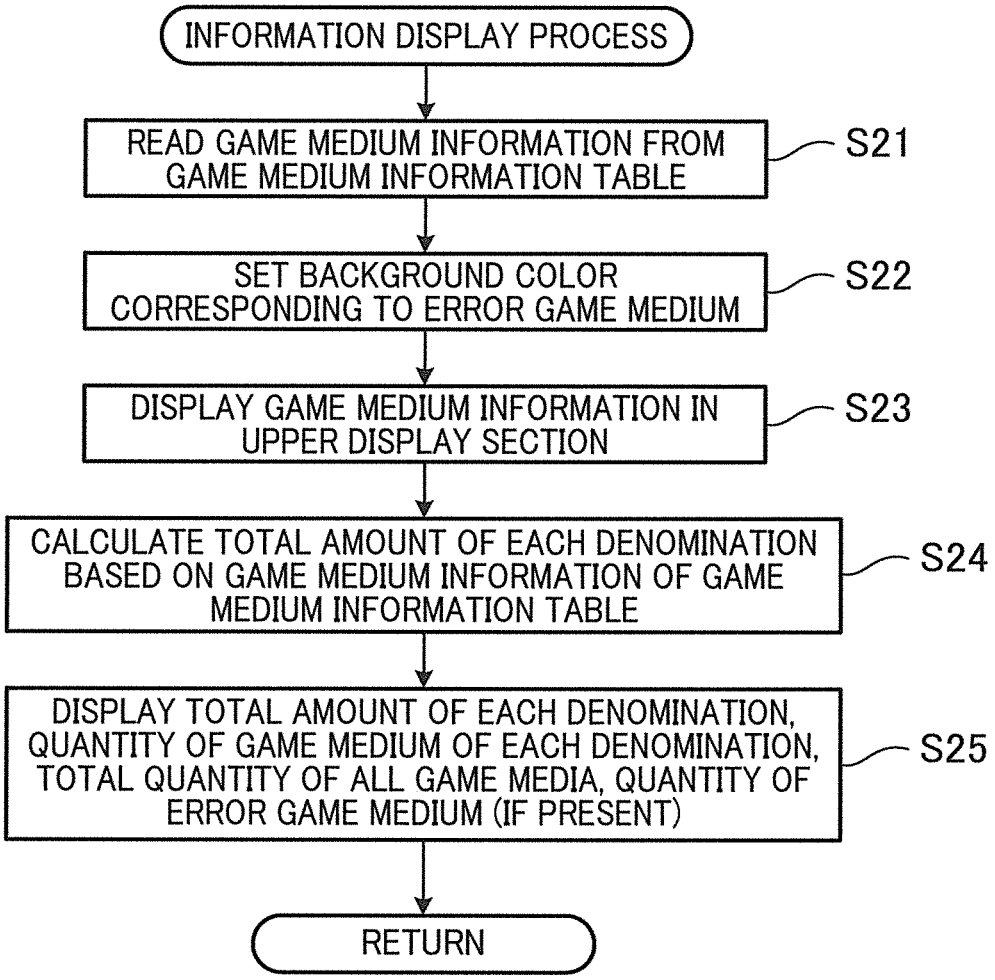
FIG. 15 is a flowchart of an information display process.

As shown in FIG. 15, when the information display process is executed in the main process, the game medium information is read from the game medium information table as shown in FIG. 10 (S21). Then, if an error game medium is present, the background color for the game medium is set (e.g. to red) (S22). Then, the game medium information sorted in accordance with the denomination, amount, and attribute is displayed in the upper display section 61 of the display device 6 (S23). Thereafter, the total amount of each denomination is calculated based on the game medium information of the game medium information table (S24). These total amounts are displayed in the denomination amount section 632 of the lower display section 63, as shown in FIG. 12. In addition, the quantity of the game media of each denomination and the total quantity of all the game media are displayed in the denomination quantity section 631 and the total quantity section 634 respectively. Further, if present, the quantity of the error game medium is displayed in the error section 633 (S25). Thereafter, the present routine is ended.

Thus, the total value of the game value for each type of game media 8 is obtained based on the game medium information read by the reading mechanism 4, and these total values are displayed on the display device 6 in association with the type of the game media 8. Thus, the type(s) and total value(s) of the game media 8 accommodated in the game medium accommodation device 1 can be visually checked immediately.

(Game Medium Accommodation Device 1: Reading Mechanism 4: Reading Main Process)

Figure 16:
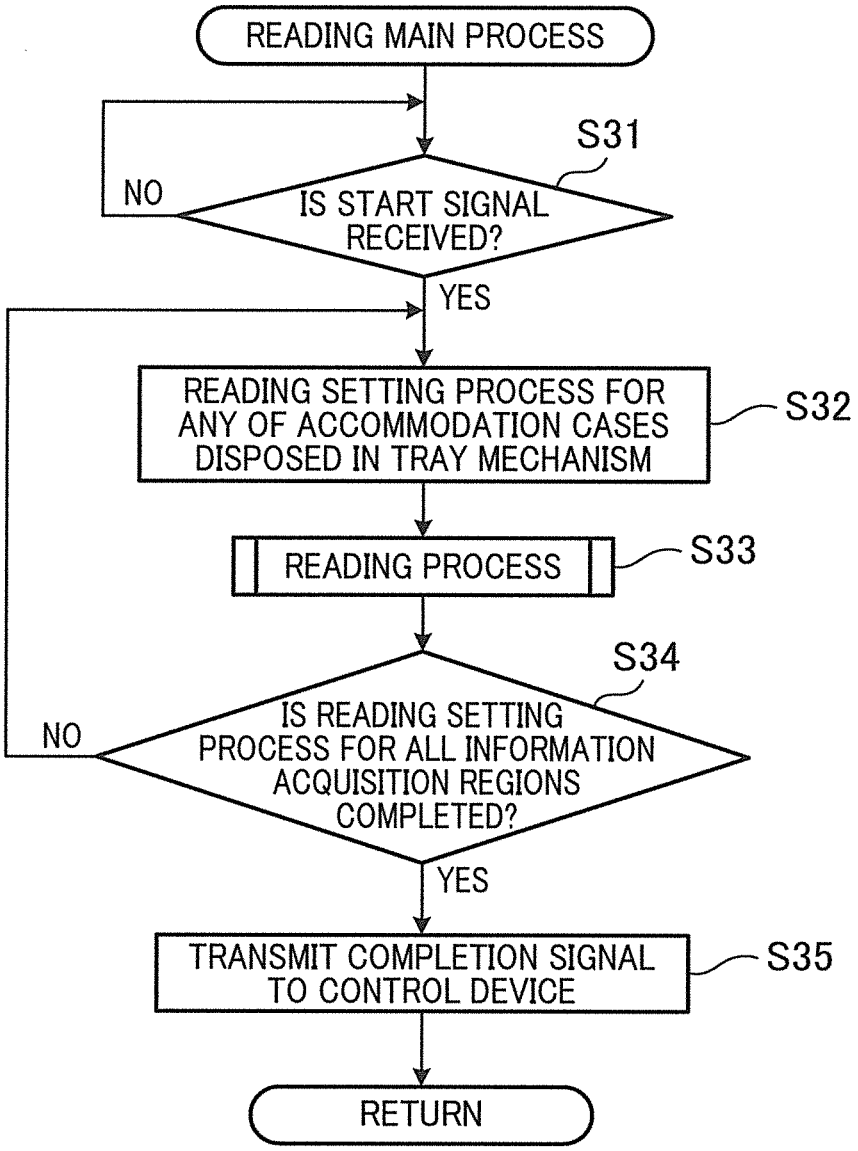
FIG. 16 is a flowchart of a reading main process.

As shown in FIG. 16, in the reading mechanism 4, the main process routine is executed, and various processes for acquiring the game medium information are performed. Specifically, first, whether or not the start signal has been received from the control device 5 is determined (S31). If the start signal is not received (S31: NO), by re-executing S31, it is in standby state until the start signal is received (S31). If the start signal has been received (S31: YES), the reading setting process is executed to any of the accommodation cases 9A to 9C disposed in the tray mechanism (S32). That is, a switch circuit of the multiplexer section 47 is set so that the modulation/demodulation section 46 as shown in FIG. 8 is connected to any of the antenna boards 11A to 11C (the first antenna to the third antenna).

Thereafter, a reading process for reading the game medium information of all the game media arranged in any of the accommodation cases 9A to 9C is executed (S33). Then, whether or not the reading setting process of all the antenna boards 11A to 11C has been completed is determined (S34). If it is not completed (S34: NO), re-execution from S32 is performed, and a setting for the antenna boards 11A to 11C in which the reading setting process has not been set is performed. Incidentally, the determination is not performed as to whether or not the accommodation cases 9A to 9C have been disposed. The reading setting process and the reading process are performed for all the accommodation cases 9 on the assumption that all the three accommodation cases 9 are disposed, even when the accommodation case 9B or the accommodation case 9C is not disposed, for example.

When the reading setting process of all the antenna boards 11A to 11C is completed (S34: YES), a completion signal is transmitted to the control device 5 (S35), and the present routine is completed. Thus, the control device 5 acquires and stores, in the game medium information table as shown in FIG. 10, the game medium information of all the game media 8 placed in the tray mechanism 2.

(Game Medium Accommodation Device 1: Reading Mechanism 4: Reading Process)

Figure 17:
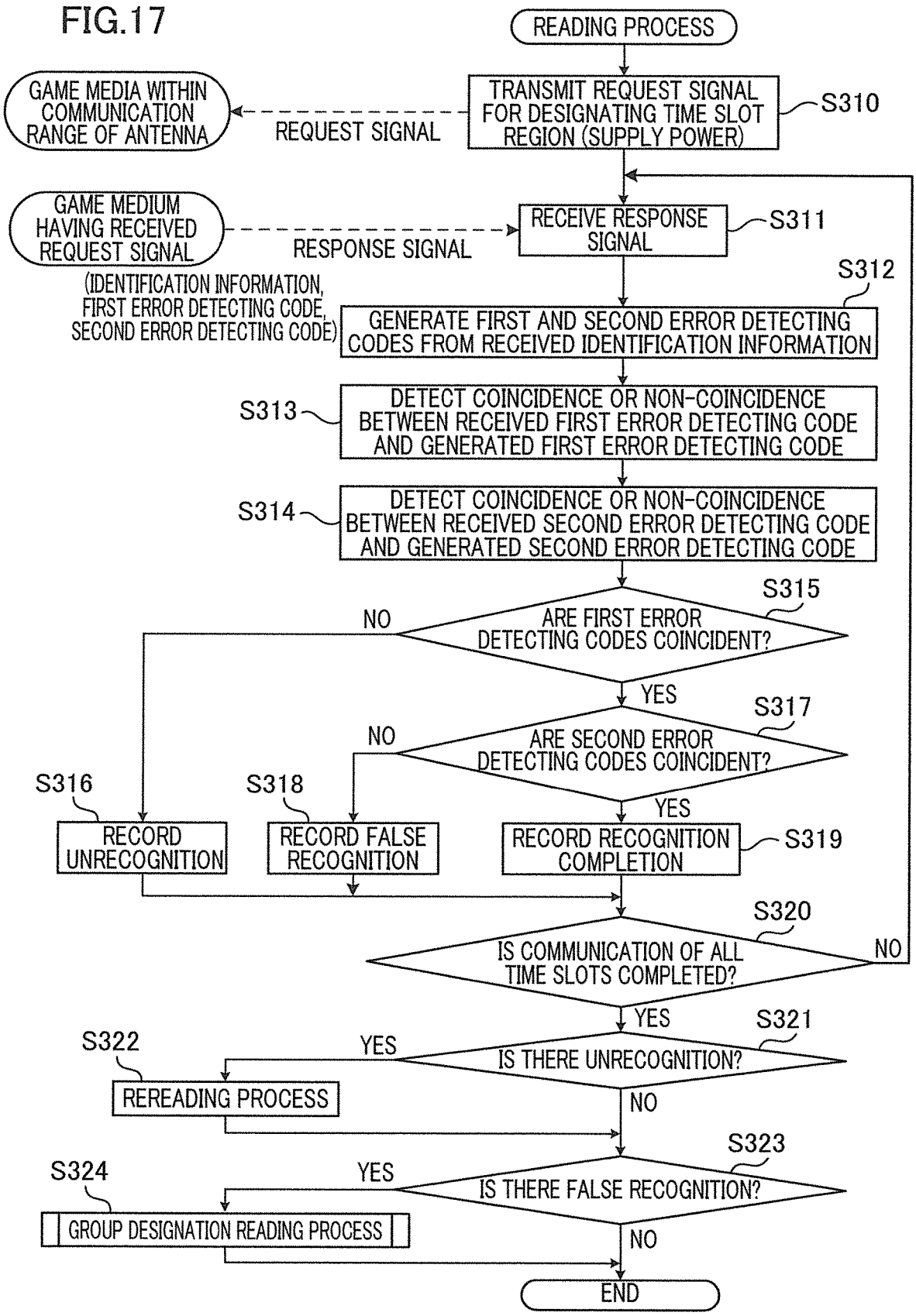
FIG. 17 is a flowchart of a reading process.

As shown in FIG. 17, when the reading process is executed in the reading mechanism 4, through the antenna boards 11A to 11C connected via the multiplexer section 47, request signals are transmitted to the RFID tags 101 of the game media 8 within the communication range of the antenna boards 11A to 11C, and a time slot region is designated (S310).

The RFID tag 101 which has received the request signal generates a 16-bit CRC code by the CRC from the identification information. Next, the RFID tag 101 which has received the request signal transmits a response signal including the identification information (64-bit UID), a first error detecting code (16-bit CRC code) and a second error detecting code (8-bit DSFID) at timings determined for each value of the time slot region.

The data lengths of the first error detecting code and the data length of the second error detecting code are shorter than the data length of the identification information. The data length of the second error detecting code is shorter than the data length of the first error detecting code. The first error detecting code and the second error detecting code are generated to have the data lengths different from each other, for example, to differentiate them from each other. The first error detecting code is generated by the RFID tag. The second error detecting code has been generated beforehand and stored in the storage section 43.

When response signals are received sequentially from each RFID tag 101 via the antenna boards 11A to 11C (S311), the first error detecting codes (16-bit UID) and the second error detecting codes (8-bit DSFID) are generated from the identification information in the response signals (S312). Thereafter, a coincidence or non-coincidence between the first error detecting code received from the RFID tag 101 in S311 and the first error detecting code generated in S312 is detected (S313). Usually, if no collision of the response signals occurs, the values of the first error detecting codes are coincident with each other.

After S313, a coincidence or non-coincidence between the second error detecting code received from the RFID tag 101 in S311 and the second error detecting code generated in S312 is detected (S314). Usually, if no collision of the response signals occurs, the values of the second error detecting codes are coincident with each other.

Next, whether or not the first error detecting codes are coincident is determined (S315). Usually, if a collision of the response signal occurs, the first error detecting codes are not coincident, and the RFID tag 101 cannot be recognized. When the response signals are transmitted from a plurality of RFID tags 101 simultaneously, a non-coincidence of the first error detecting codes is detected at S313 due to the change in data value. In this case, it is determined that the first error detecting codes are not coincident with each other (S315: NO), and unrecognition is recorded in the memory 33 as the communication result in the time slot region (S316).

Usually, when the response signals are collided with each other, a non-coincidence of the first error detecting codes is detected in S313. However, even if the response signals are collided with each other, accidentally, the received first error detecting code and the generated first error detecting code may be coincident. The identification information recognized to be correct in this situation is the so-called ghost ID, and the RFID tag 101 recognized to be correct is the so-called ghost game medium.

When a plurality of RFID tags having different identification information simultaneously start the communication by using the same time slot with the same spread code, the probability that errors cannot be detected by the n-bit CRC, is the probability that the n-bit CRC code which is generated from the identification information (DATAX) synthesized during reception is accidentally coincident with the n-bit first error detecting code (CRC X) synthesized during reception. This probability can be expressed as $2^{-n}$ (−n means a negative exponent). In the present embodiment, since the 16-bit CRC code is used as the first error detecting code, ghost chips occur with a probability of $2^{-16}=1/65536$.

In S315, if the first error detecting codes are determined to be coincident (S315: YES), subsequently, whether or not the second error detecting codes are coincident is determined (S317). If the first error detecting codes are coincident and the second error detecting codes are not coincident, a false recognition of the first error detecting codes is generated due to the collision of the response signals. In this case (S317: NO), the false recognition is recorded in the memory 33 as the communication result in the time slot region (S318).

On the other hand, in S317, if it is determined that the first error detecting codes are coincident and the second error detecting codes are coincident, it is determined that normal recognition of the RFID tags 101 is performed. In this case (S317: YES), recognition completion is recorded in the memory 33 as the communication result in the time slot region (S319).

After the execution of S316, S318 or S319, whether or not the communication of all the time slots within the communication range of each of the antenna boards 11A to 11C is completed is determined (S320). If it is determined that the communication of all the time slots is not completed (S320: NO), the process returns to S311. On the other hand, if it is determined that the communication of all the time slots is completed (S320: YES), whether or not there is a record of unrecognition in the memory 33 is determined (S321).

If it is determined there is a record of unrecognition (S321: YES), a rereading process is executed. In the rereading process, a request signal for designating another time slot region (for example, No. 17 to No. 32 bit from the lowest bit in the 64-bit UID) different from the time slot region designated in S310 is transmitted. If it is determined that there is no record of unrecognition in the storage section 43 (S321: NO), or after the process of S322 is executed, whether or not there is a record of false recognition in the storage section 43 is determined (S323). If it is determined that there is no record of false recognition (S324: NO), the present process is completed. On the other hand, if it is determined that there is a record of false recognition (S324: YES), after the group designation reading process is performed (S324), the present process is ended.

To explain the group designation reading process in detail, a designation signal for designating the same time slot region and time slot value as the time slot region and time slot value at the time when the false recognition of the first error detecting code is generated, and designating one group. The designation signal includes a group code, and performs the designation of group by the group code. The number of the groups is the number of the value that the group code can obtain ($2^n$: the nth power of 2). In the present embodiment, since the group code is 8-bit, the number of the groups is 256 which are 2 raised to the power of 8. It should be noted that, the present invention is not limited to this example. Only required is that the number of the groups, and the number of the group codes used in the game media 8 arranged in the tray mechanism 2 are be the same.

The RFID tag 101 that has received the designation signal transmits an answer signal including the group code, the identification information and the first error detecting code. The data length of the group code is shorter than the identification information, the first error detecting code and the second error detecting code. The group codes are previously allocated to each RFID tag 101, and stored in the storage section 43.

Thereafter, the answer signals are received from the RFID tags 101 via the antenna boards 11A to 11C, and a process of specifying the chip of false recognition is performed. In this process, the first error detecting code is generated from the identification information included in the received designation signal, and recognition of the chip is performed by comparing the generated first error detecting code with the first error detecting code included in the received designation signal. Then, the fact that the recognition with respect to the group has been completed is recorded in the memory 33. The process is performed until the reading of all the groups is completed.

Embodiment 2

The game medium accommodation device according to the second embodiment of the present invention will be described based on the figures. With respect to the components common to the first embodiment, the description thereof is omitted by using the same names.

(Outline of Game Medium Accommodation Device A1)

Figure 18:
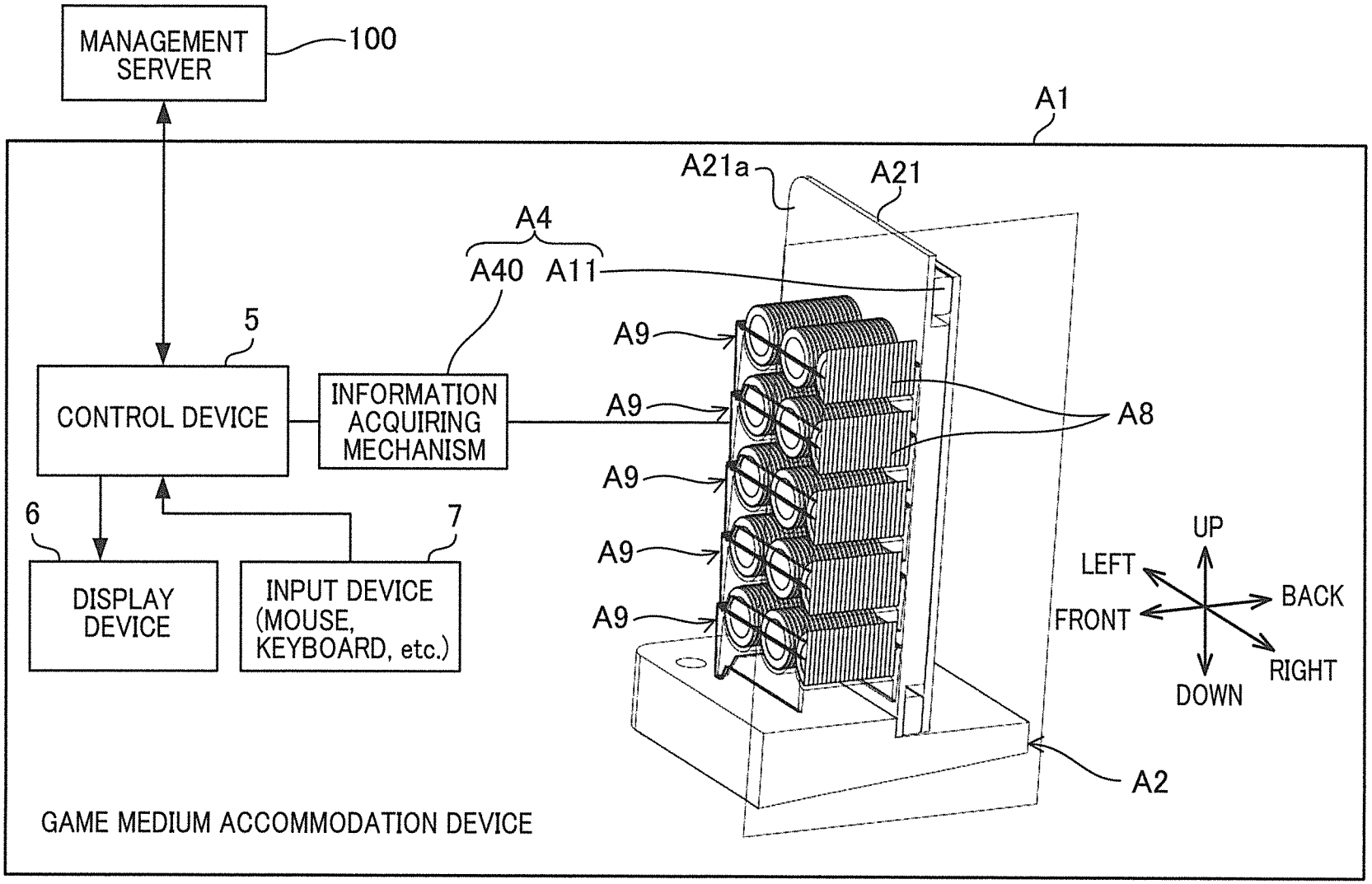
FIG. 18 is a block diagram showing a schematic configuration of a game medium accommodation device of the second embodiment.

As shown in FIG. 18, a game medium accommodation device A1 is configured to accommodate one or more game media A8 each having game medium information in such a manner that the game medium information can be output by radio communication. It should be noted that, in the following description, a case where the game medium A8 is a precise circular flat plate-shaped chip will be described. All the game media A8 used in the game medium accommodation device A1 are the same shape. Similar to the first embodiment, each game medium A8 contains an RFID tag 101 at its center portion.

The game medium accommodation device A1 includes a tray mechanism A2 and a reading mechanism A4. The tray mechanism A2 is configured so that a plurality of accommodation cases A9 each accommodating the game media A8 are stacked therein in the up-down direction along the reading surface 21*a* continuing in the up-down direction. Each accommodation case A9 is capable of accommodating one or more bundles each formed of the game media A8 aligned in the horizontal direction. In the accommodation case A9, one or more such bundles of the game media 8 can be arranged. The reading mechanism A4 includes an antenna mechanism A11 disposed on the reading surface A21*a*, and an information acquiring mechanism A40 configured to acquire electronic information of the game media A8 arranged in the tray mechanism A2 via the antenna mechanism A11. The reading mechanism A4 is capable of reading the electronic information relating to game medium A8 and stored inside the game media A8, by radio communication between the antenna mechanism A11 and the game media A8.

The tray mechanism A2 is configured to allow the accommodation cases A9, each having a plurality of bundles of the aligned game media A8 lined up in the horizontal direction, to be stacked in the up-down direction along the reading surface A21*a*. The antenna mechanism A11 is disposed on the reading surface 21*a*. The reading mechanism A4 is capable of reading the game medium information from the game media A8, by radio communication between the antenna mechanism A11 and the game media A8. Further, the game medium accommodation device A1 includes the display device 6 and the control device 5 similar to those in the first embodiment.

(Details of Game Medium Accommodation Device A1)

The above-mentioned game medium accommodation device A1 will be described in detail.

(Game Medium Accommodation Device A1: Accommodation Case A9)

Figure 19A:
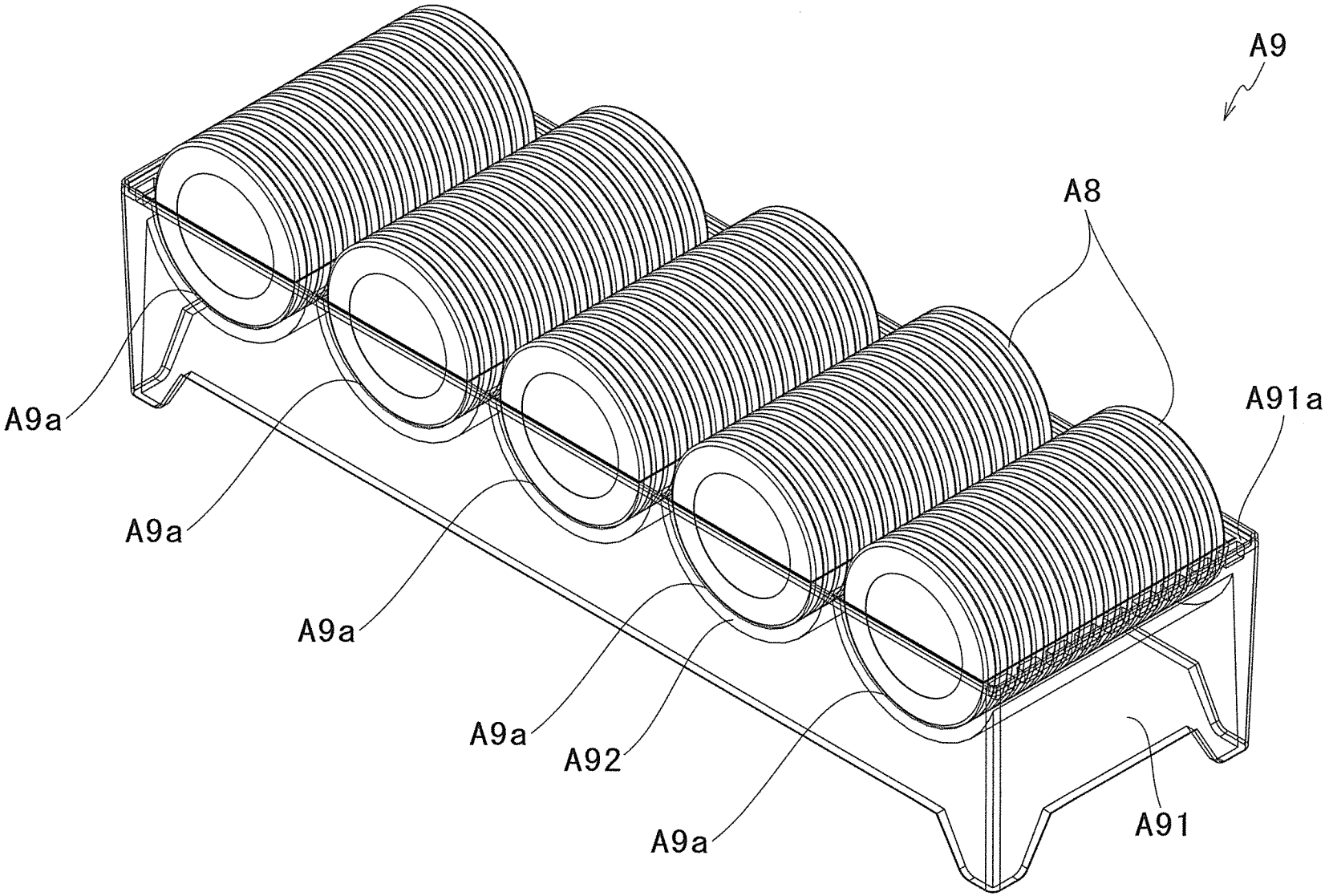
FIG. 19A is a perspective view of an accommodation case.

As shown in FIG. 19A, the accommodation case A9 has five accommodation portions A9*a* arranged in the horizontal direction. Each accommodation portion A9*a* is capable of accommodating a bundle of twenty game media A8 aligned.

That is, each accommodation case A9 is able to accommodate one hundred game media 8.

The accommodation case A9 has a side wall A91 and a bottom wall A92. The bottom wall A92 has convexo-concave for supporting the game medium A8 stably. Specifically, the bottom wall A92 is formed with five continuous recessed portions each of which matches the outer shape of the columnarly aligned game media 8 cut along the plane passing through the central axes of the game media 8. That is, the bundles of the game media A8 aligned to make a columnar shape are lined up on the bottom wall A92. The side wall A91 functions as an outer wall which positions the game media A8 so that the game media A8 arranged on the bottom wall A92 are at a predetermined height, and the side wall A91 regulates the movement of the arranged game media A8 toward the abovementioned central axis. Further, an upper peripheral edge of the side wall A91 has a fitting portion A91*a* having a stepwise cross section and having a larger inner diameter. The inner diameter of the fitting portion A91*a* is set to be larger than the outer diameter of the lower edge portion of the side wall A91 of the accommodation case A9. Thus, in the fitting portion A91*a* of the accommodation case 9, the lower edge of other accommodation case A9 can be fitted, and it is possible to stack a plurality of the accommodation cases A9 in the up-down direction. In the present embodiment, although all the game media A8 used have the same shape, similar to the first embodiment, game media of different sizes may be used with a spacer member.

Figure 19B:
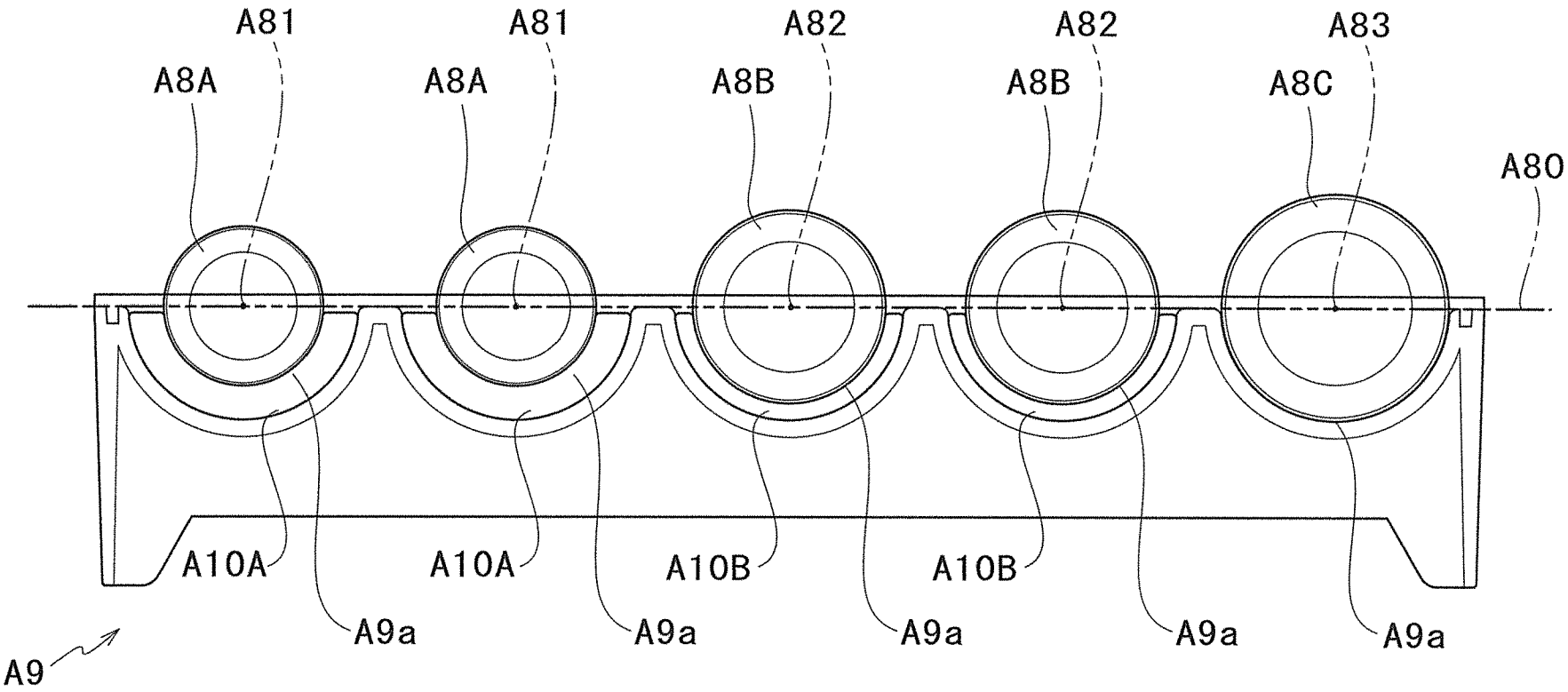
FIG. 19B is an explanatory drawing showing a state in which game media are accommodated in the accommodation case through a spacer member.

For example, as shown in FIG. 19B, the accommodation case A9 may have attachable/detachable spacer members A10 in each accommodation portion A9*a*. The spacer members A10 are formed so as to set the center portions of game media A8 of various sizes at the same distance from the bottom surface of the accommodation case A9. That is, depending on the sizes of the game media A8, spacer members A10 for setting the center portions of the game media 8 at the same position are selected. As shown in FIG. 19B, in the accommodation case A9, the spacer member 10A, and the spacer member 10B can be selected according to size in correspondence with the small-sized game medium A8A, the medium-sized game medium A8B, and the large-sized game medium A8C.

Specifically, as shown in FIG. 19B, a game medium A8A can be accommodated in the accommodation portions A9*a* to each of which a spacer member A10A is attached. Further, a game medium A8B can be accommodated in the accommodation portions A9*a* to each of which a spacer member A10B is attached. Further, a game medium A8C can be accommodated in the accommodation portion A9*a* without any of the spacer members A10A and A10B. Then, the center portions A81, A82, and A83 of the thus accommodated game media A8A, A8B and A8C of various sizes, are located at the same distance from the bottom surface of the accommodation case A9. That is, the heights of the spacer members A10A and A10B are set in accordance with the height of the center portion A83 of the game medium A8C accommodated in the accommodation portion A9*a*.

(Game Medium Accommodation Device A1: Tray Mechanism A2)

Figure 20A:
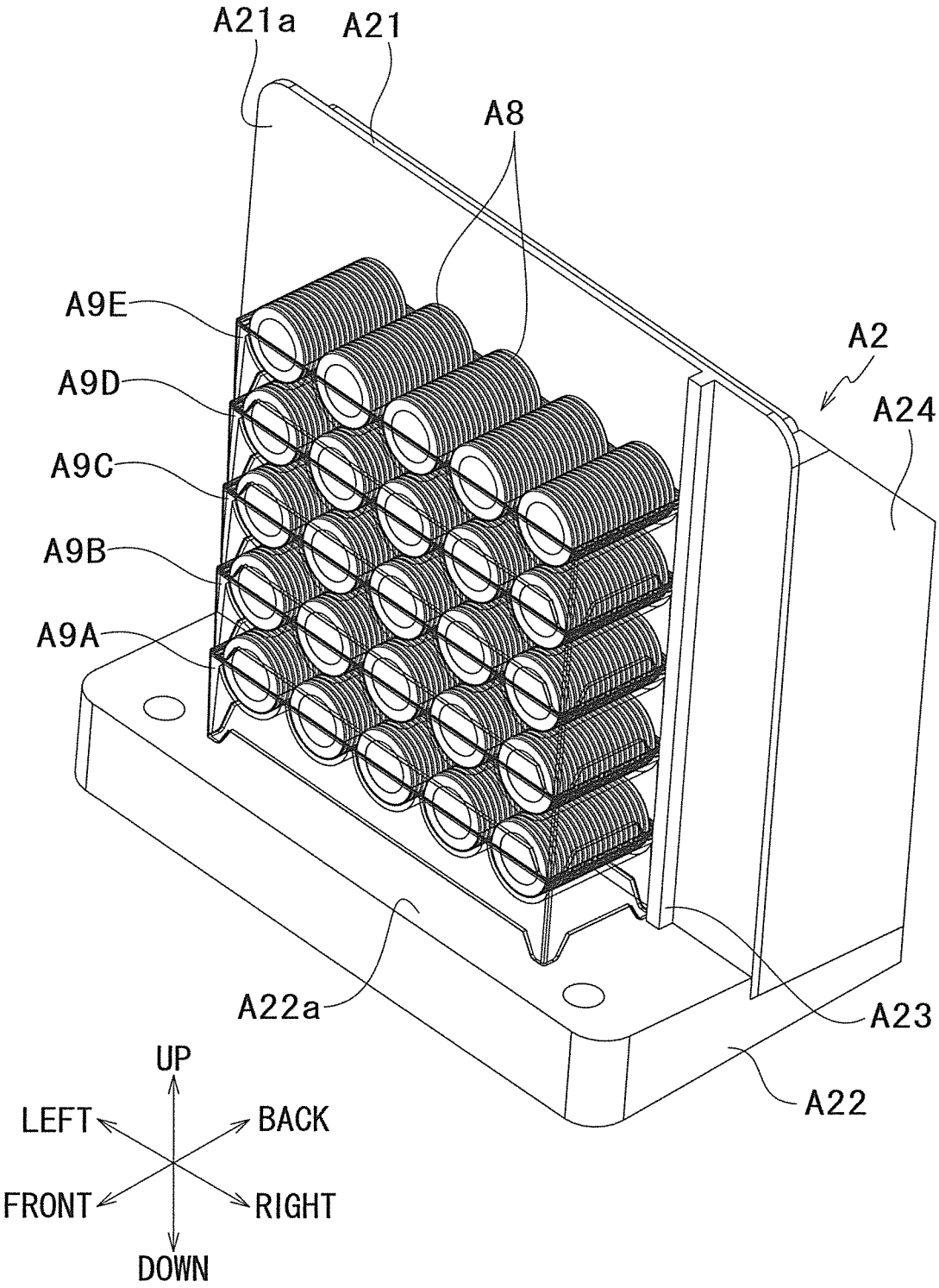
FIG. 20A is a perspective view of the accommodation case and the tray mechanism.

As shown in FIG. 20A, five accommodation cases A9A to A9E stacked in the up-down direction can be disposed in the tray mechanism A2. That is, 500 game media A8 can be arranged in one tray mechanism A2. The tray mechanism A2 includes an arrangement plate A21, a pedestal portion A22, a guide portion A23, and an antenna accommodation portion A24.

Figure 20B:
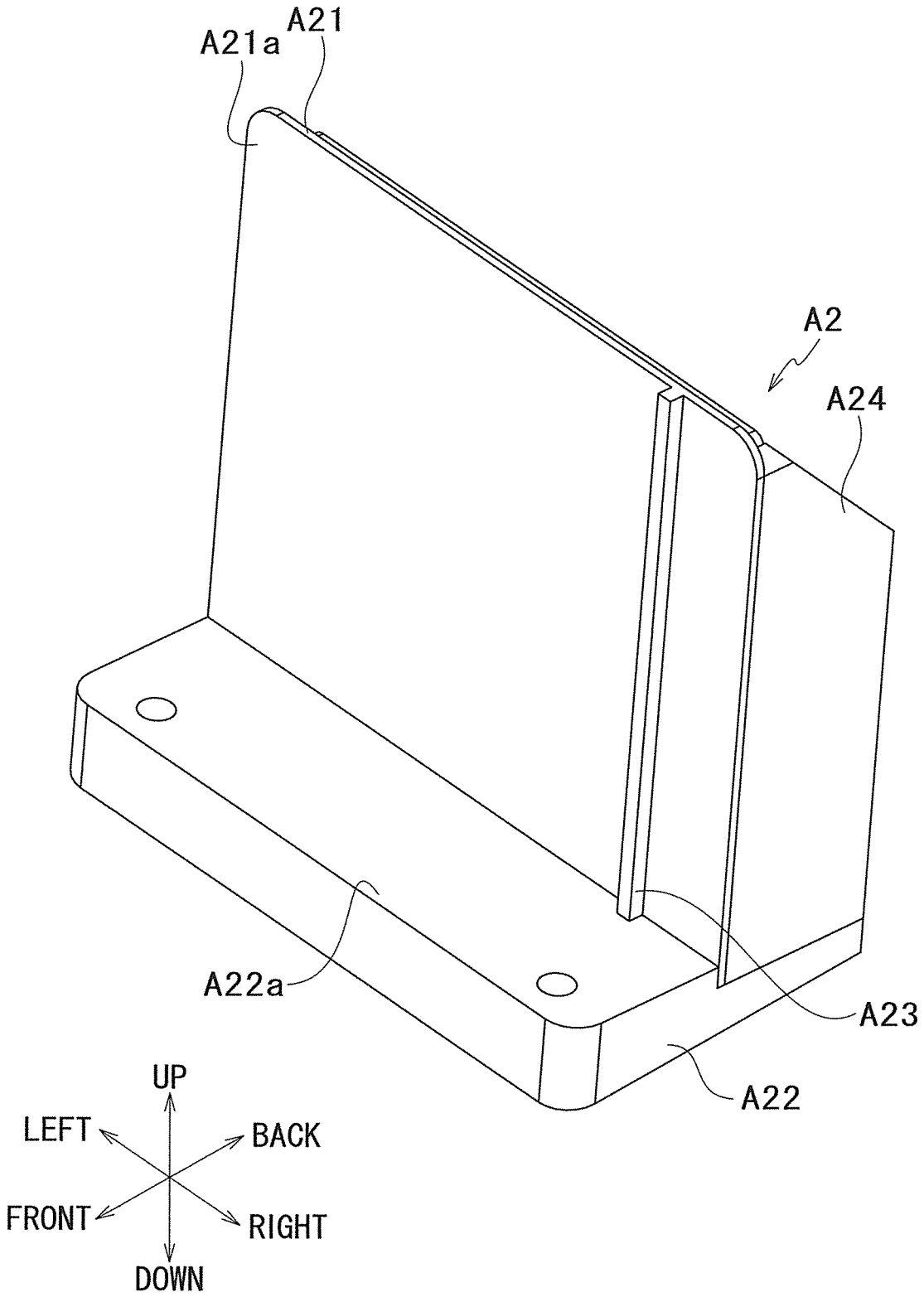
FIG. 20B is a perspective view of the tray mechanism.

As shown in FIG. 20A and FIG. 20B, the arrangement plate A21 and the antenna accommodation portion A24 are disposed to be supported by the placing surface A22*a* which is the upper surface of the pedestal portion A22 constituting the lower portion of the tray mechanism A2. The arrangement plate A21 is a flat plate-shaped member having a reading surface A21*a* abutting against the rear sides of the five accommodation cases A9A to A9E stacked in the up-down direction. On the reading surface A21*a*, a guide portion A23 extending in the up-down direction is formed. The antenna accommodation portion A24 is disposed on the rear surface of the arrangement plate A21, and accommodates the antenna mechanism A11 in its internal space.

Figure 20C:
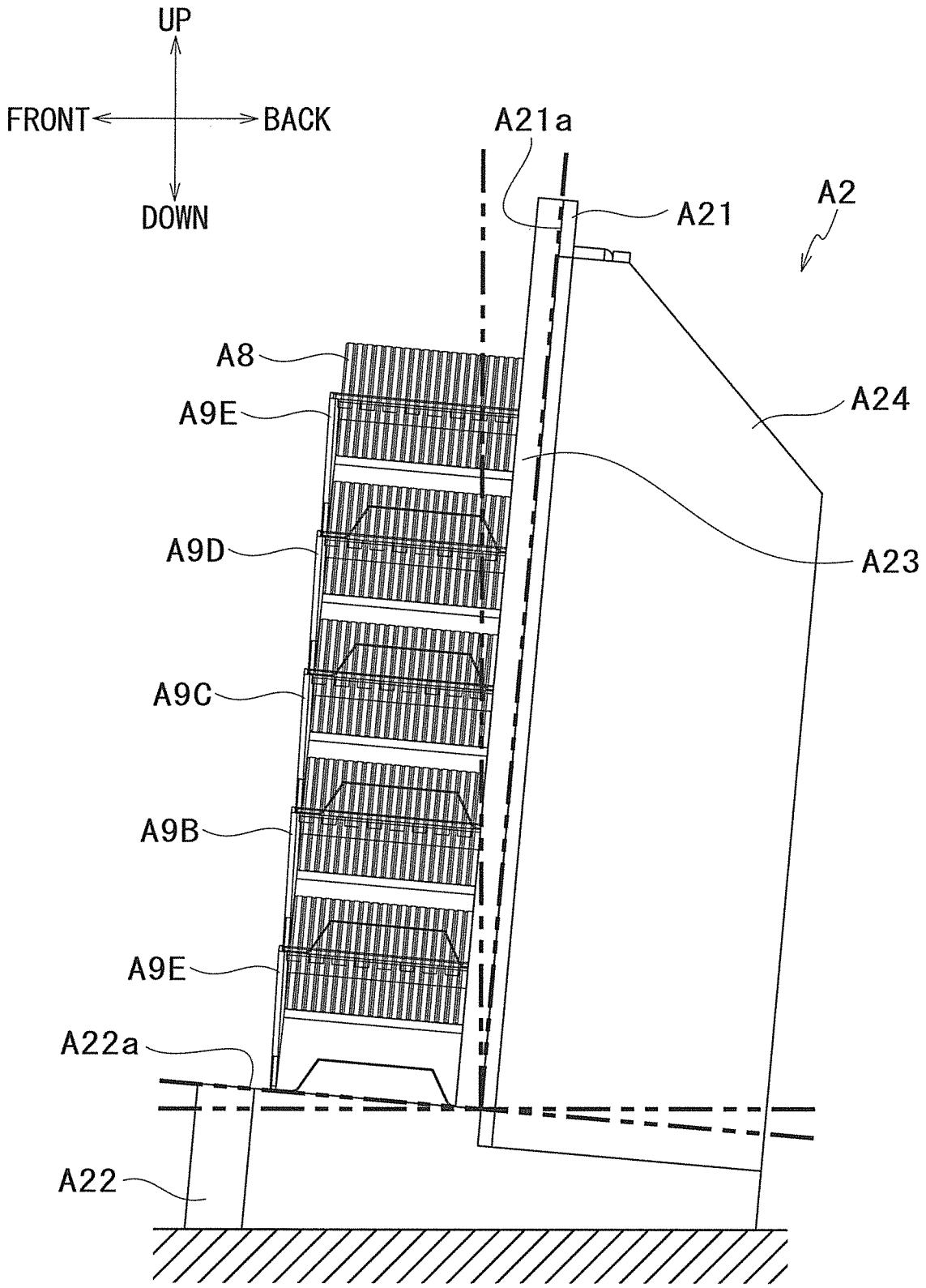
FIG. 20C is a side view of the tray mechanism.

As shown in FIG. 20C, the tray mechanism A2 is formed so that a line perpendicular to the reading surface A21*a* of the arrangement plate A21 declines toward the side of antenna accommodation portion A24 accommodating the antenna mechanism A11 of the reading mechanism A4. That is, the placing surface A22*a* provided perpendicular to the reading surface A21*a* is also inclined. Thus, the tray mechanism A2 is formed with the placing surface A22*a* for the accommodation cases A9 which extends from the reading surface A21*a* in the horizontal direction. Then, the placing surface A22*a* is formed in an inclined shape so that a plurality of the accommodation cases A9A to A9C can be stacked in the up-down direction along the reading surface 21*a*.

Thus, when stacking the accommodation cases A9A to A9E in the up-down direction along the reading surface A21*a*, since the placing surface A22*a* for placing the accommodation cases 9 is inclined, the accommodation cases A9A to A9E stacked in the up-down direction (longitudinal direction) lean against the reading surface A21*a*, to be maintained in a state along the reading surface A21*a*. That is, the accommodation cases A9A to A9E are positioned in the front-back direction and the up-down direction when placed on the placing surface A22*a* in the tray mechanism 2. Further, the accommodation cases A9A to A9E are positioned in the left-right direction when moved toward the right direction to abut against the guide portion A23. Therefore, even when each accommodation portion A9*a* of the accommodation cases A9 accommodating the game media A8 the number of which is less than the maximum accommodation number, the risk that the game media A8 may fall to the side opposite to the side of the reading surface A21*a* by own weight is reduced. As a result, the risk that the communication distance between the antenna mechanism A11 on the reading surface A21*a* side and the game media A8 increases to deteriorate the performance of the radio communication can be reduced.

Figure 20D:
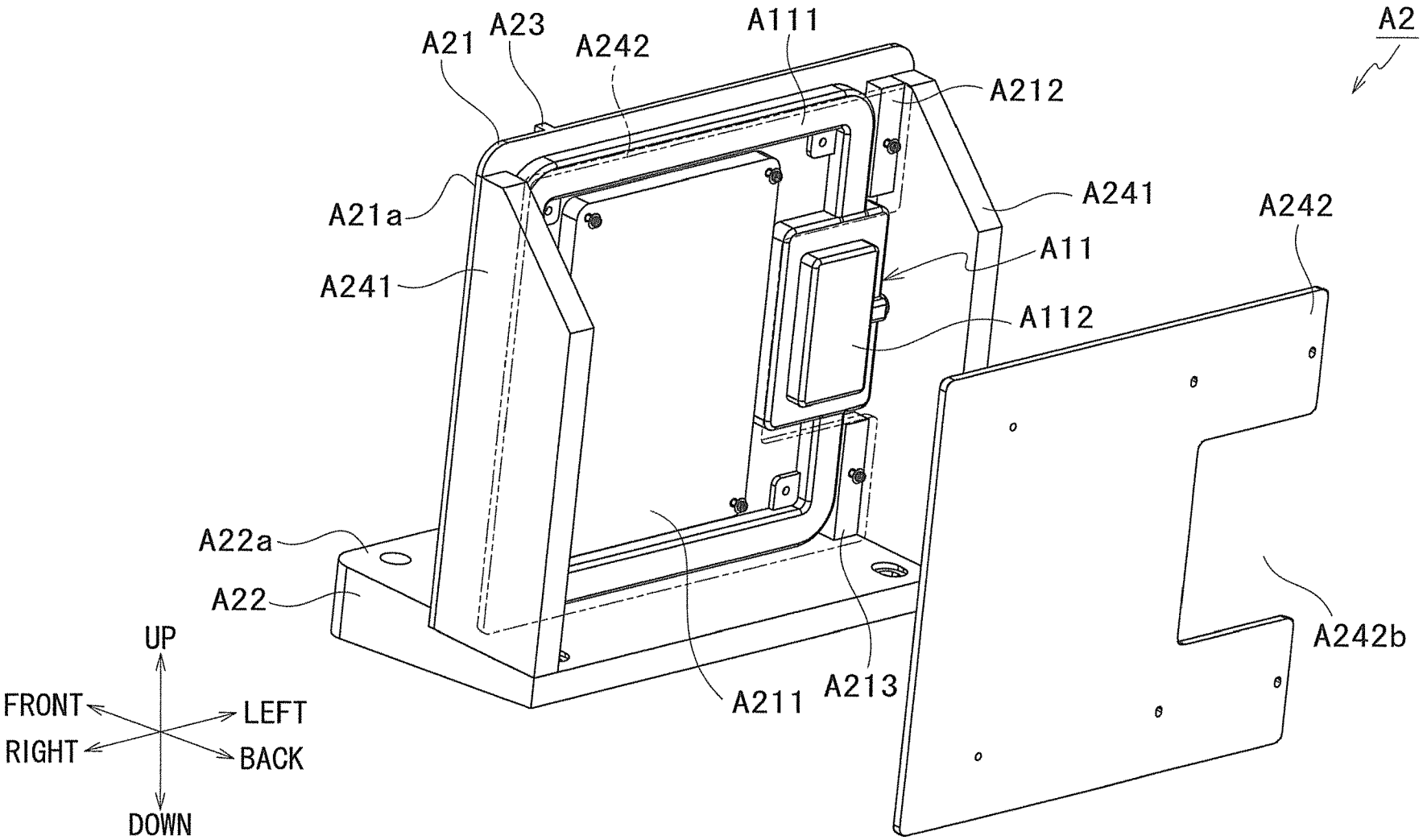
FIG. 20D is a partial exploded perspective view of the tray mechanism.
Figure 20E:
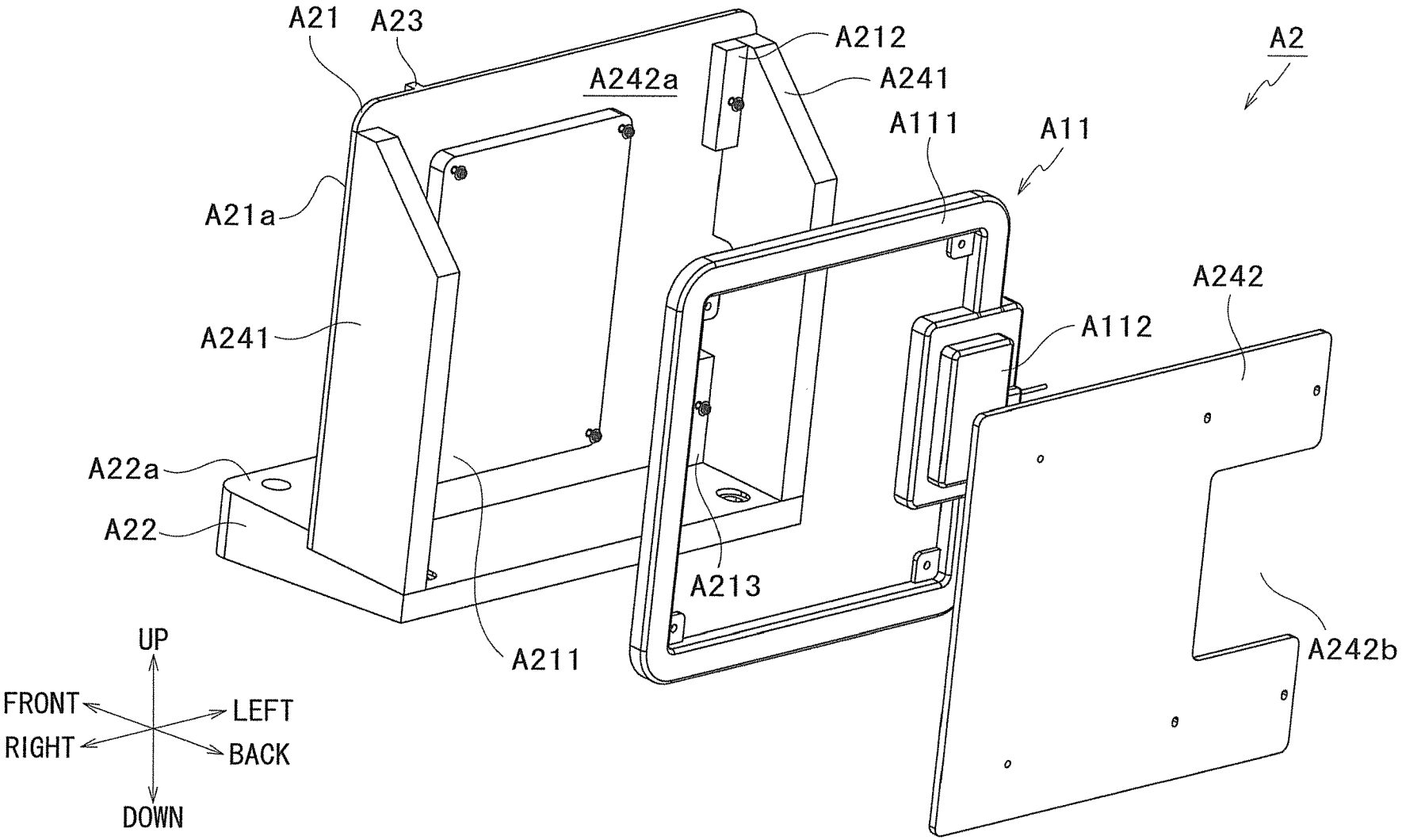
FIG. 20E is a partial exploded perspective view of the tray mechanism.

As shown in FIG. 20D and FIG. 20E, the antenna mechanism A11 is disposed on the surface of the arrangement plate A21, which surface is opposite to the reading surface A21*a*, in the accommodation space A242*a* of the antenna accommodation portion A24. Specifically, the antenna accommodation portion A24 includes support portions A241 and an accommodation plate A242. The support portions A241 are two plate members formed on the surface on the side opposite to the reading surface A21*a* along both edge portions in the left and right directions of the arrangement plate A21. The support portions A241 are formed to be raised from the placing surface A22*a*, and support the arrangement plate A21 from the back surface. The accommodation plate A242 is a flat plate member disposed to cover the region between the support portions A241 on the surface opposite to the reading surface A21*a*. The accommodation plate A242 has a cutout region A242*b* at the center of a left end region to expose the accommodation space A242*a*.

In the arrangement plate A21, a flat plate member A211 is attached to the center portion of the surface on the opposite side. Further, to the arrangement plate A21, rectangular parallelepiped members A212 and A213 each having the same thickness in the front-back direction as that of the flat plate A211 are attached. The members A212 and A213 are spaced apart from each other in the up-down direction, at a left edge on the surface on the opposite side. The accommodation plate A242 is fixed to the flat plate member A211 and the rectangular parallelepiped members A212 and A213 by screws. Further, the flat plate member A211 and the rectangular members A212 and A213 define the accommodation space A242*a* in a circular shape, when the accommodation plate A242 is disposed on the arrangement plate A21. The antenna mechanism A11 is formed in a circular shape so as to be disposed along the accommodation space A242*a* which is formed in a circular shape. Specifically, the antenna mechanism A11 includes an antenna section A111 and a tuner section A112.

The antenna section A111 is formed to have a cross-section of the same diameter in a circular shape disposed along the periphery of the flat plate A211. Further, the antenna section A111 is disposed along the reading surface A21*a* to cover the entire region where the game media A8 are arranged in the tray mechanism A2. That is, the reading region of the antenna mechanism A11 is composed of all the game media A8 arranged in the tray mechanism A2.

The tuner section A112 is disposed in a position corresponding to the cutout region A242*b*, as a part of the circular shape formed by the antenna section A111. The tuner section A112 contains a coupler board having an antenna tuner for reducing the loss of radio wave, and a ferrite core for reducing the high-frequency noise (not shown). The tuner section A112 is exposed through the cutout region A242*b* while the antenna mechanism A11 is covered with the accommodation plate A242. Thus, malfunction due to an excessive temperature rise caused by the coupler board or the ferrite core is prevented.

(Game Medium Accommodation Device A1: Reading Mechanism A4)

Figure 21:
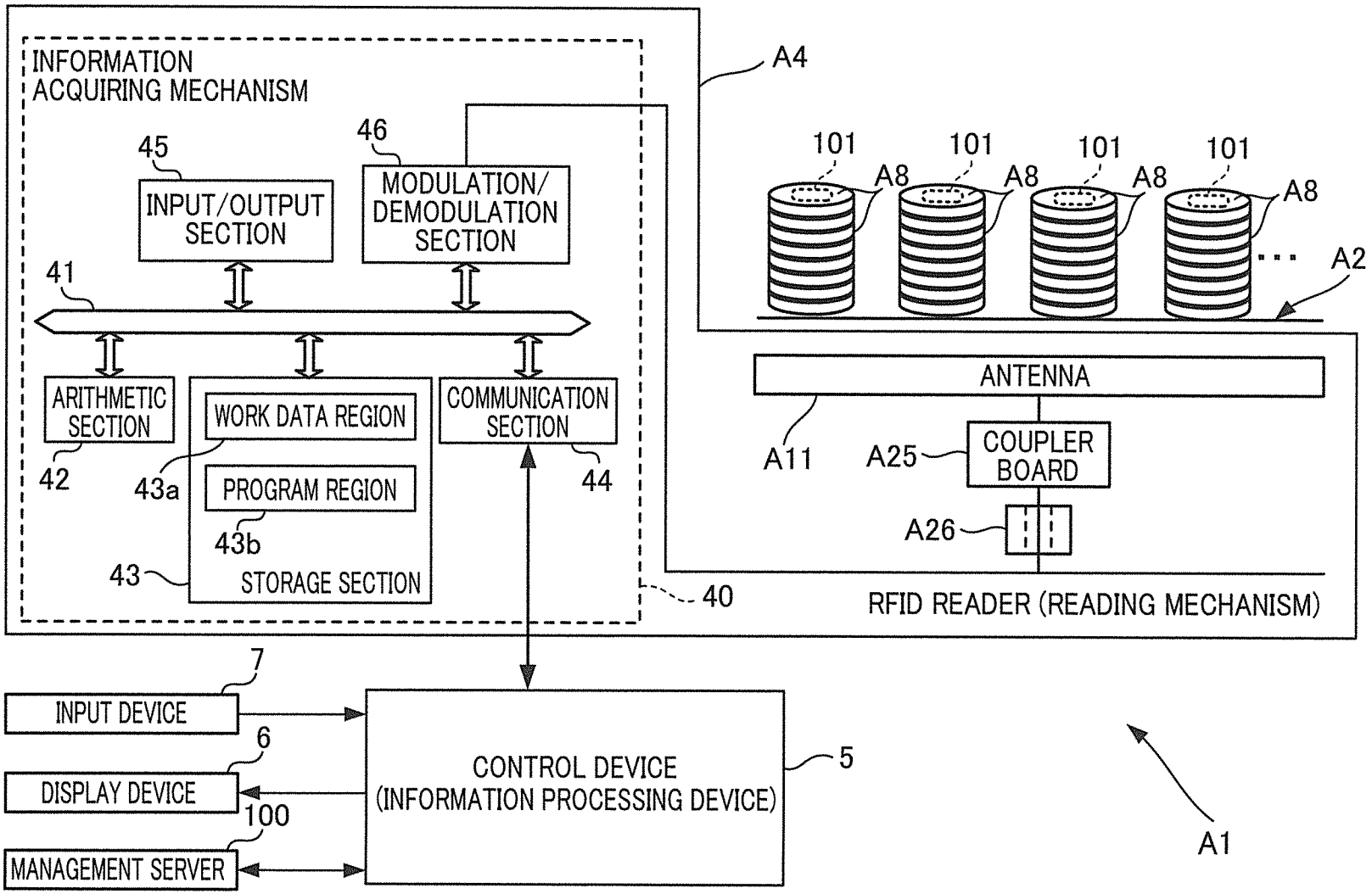
FIG. 21 is an explanatory drawing showing an electrical configuration of the game medium accommodation device.

As shown in FIG. 21, the reading mechanism A4 is configured by an RFID reader including the antenna mechanism A11 and the information acquiring mechanism A40. In the reading mechanism A4, the antenna board A11 (antenna) is connected to the information acquiring mechanism A40 via the coupler board A25 having an antenna tuner for reducing the loss of radio wave. The signal line connecting the information acquiring mechanism A40 and the coupler board A25 is inserted into the ferrite core A26 for reducing the noise mixed in the signal line. The coupler board A25 and the ferrite core A26 are accommodated in the tuner section A112 (see FIG. 20D, FIG. 20E) of the antenna mechanism A11. As described above, the antenna mechanism A11 is disposed on the reading surface A21*a* of the tray mechanism A2. The reading mechanism A4 is configured to acquire the game medium information including the game values of the game media A8 arranged in the tray mechanism A2.

The information acquiring mechanism A40 has the same configuration as the information acquiring mechanism 40 of the first embodiment, except that there is no multiplexer section 47. That is, only the signal from the antenna mechanism A11 is input into the modulation/demodulation section 46. Thus, the information acquiring mechanism A40 does not include the multiplexer section 47 since there is no need to switch the antenna by the switch circuit; however, the information acquiring mechanism A40 may include the multiplexer section 47.

The reading mechanism A4 executes the same processes as the reading main process, and the reading process of the first embodiment. However, the reading mechanism A4 does not perform the process of switching the antenna in the reading main process.

(Game Medium Accommodation Device A1: Control Device A5)

The control device A5, in the same manner as the control device 5 of the first embodiment, is constituted by an information processing device such as a personal computer. The control device 5 is connected to the display device 6 and the input device 7.

The control device A5 executes the same processes as the main process, the information acquisition process and the information display process of the first embodiment. In this way, the control device A5 obtains the total value of the game value for each type of the game media 8 arranged in the tray mechanism A2, and displays these total values on the display device 6 as the chip bank screen as shown in FIG. 11 and FIG. 12, in accordance with the type of the game media 8. Thus, the type and total value of the game media 8 accommodated in the game medium accommodation device 1 can be visually checked immediately.

Embodiment 3

The game medium accommodation device according to the third embodiment of the present invention will be described based on the figures. Further, with respect to the components common to the above-mentioned embodiments, the description thereof is omitted by using the same names.

A game medium accommodation device B1 of the present embodiment is provided in an exchange place or the like where the player exchanges cash for chips used in the game. The game medium accommodation device B1 has two display devices for displaying chip bank screens having the same content. For example, a staff places one or more chips corresponding to the amount of the cash received from the player on the game medium accommodation device B1. With this, the staff can confirm the game medium information of the chip on one display device, and at the same time, make the player confirm the game medium information on the other display device.

Figure 22:
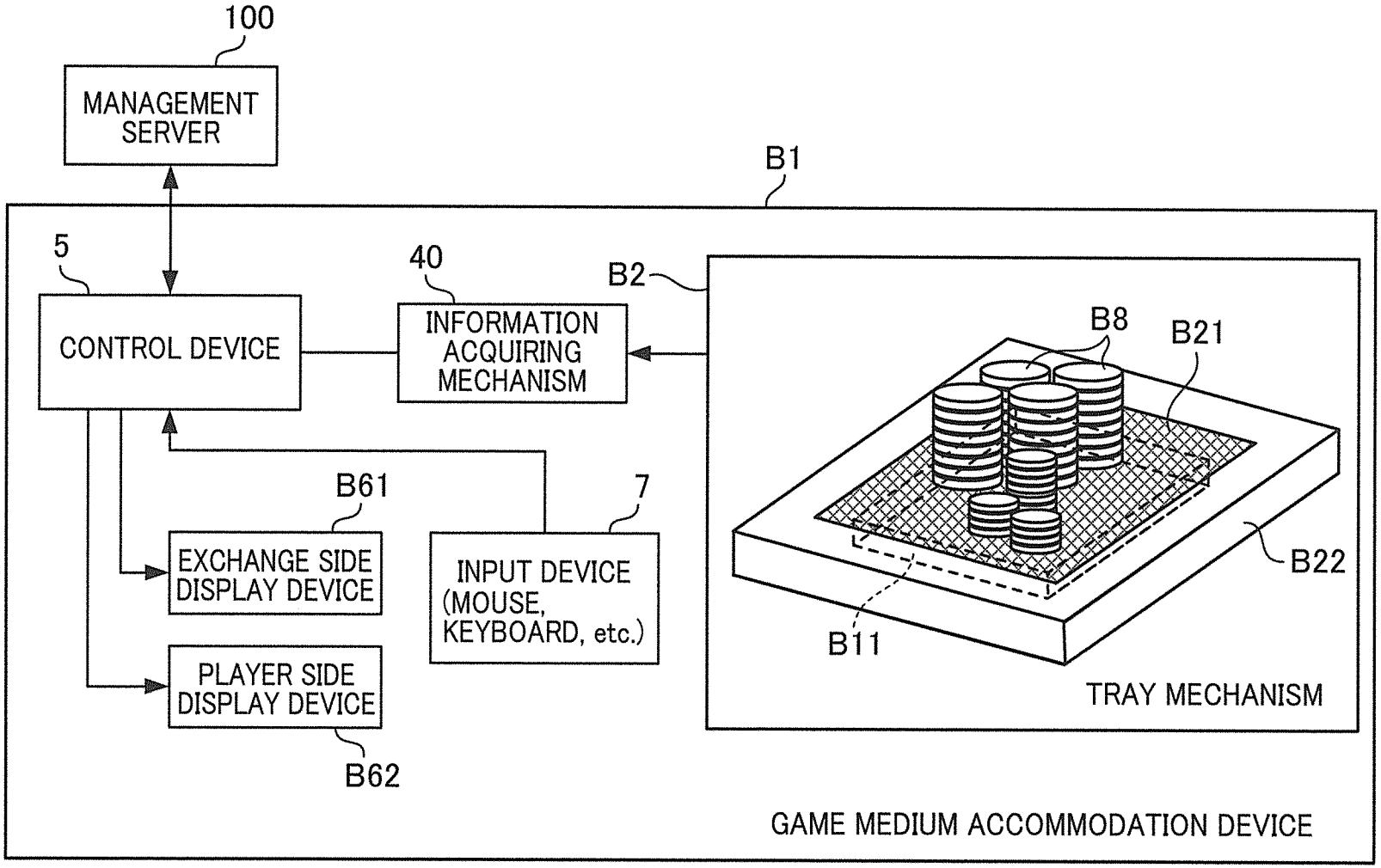
FIG. 22 is a block diagram showing a schematic configuration of a game medium accommodation device of the third embodiment.

Specifically, as shown in FIG. 22, the game medium accommodation device B1 includes an exchange side display device B61, a player side display device B62, an information acquiring mechanism 40, a tray mechanism B2, and a control device 5. The exchange side display device B61 and the player side display device B62 each employs a device for displaying characters, images and/or video, such as a liquid crystal display, a plasma display, an organic EL display and the like. Mutually different types may be used for the exchange side display device B61 and the player side display device B62.

The tray mechanism B2 has a flat plate-shaped arrangement plate B21 disposed horizontally, and a frame body B22 having the arrangement plate B21 on the upper surface. An antenna mechanism B11 is disposed on the lower surface of the arrangement plate B21. In the antenna mechanism B11, an antenna or the like for performing the radio communication with antenna included in the game medium B8 is disposed. Incidentally, the antenna may be disposed at any form, as long as the radio communication with the game medium B8 placed on the region of the arrangement plate B21 is possible.

The reading operation of reading electronic information of the one or more game media 8 placed on the arrangement plate B21 is performed in the same manner as that in the embodiment described above, and the same chip bank screen (see FIG. 9 and FIG. 10) is displayed on the exchange side display device B61 and the player side display device B62. Thereby, an erroneous exchange by the staff can be prevented. Further, since the exchange service can be conducted accurately for the player, the trust from the player can be earned.

The above embodiments thus described solely serves as specific examples of the present invention, and the present invention is not limited to such examples. Specific configurations of various means may be suitably designed or modified. Further, the effects of the present invention described in the above embodiments are not more than examples of most preferable effects achievable by the present invention. The effects of the present invention are not limited to those described in the embodiments described above.

Figure 23:
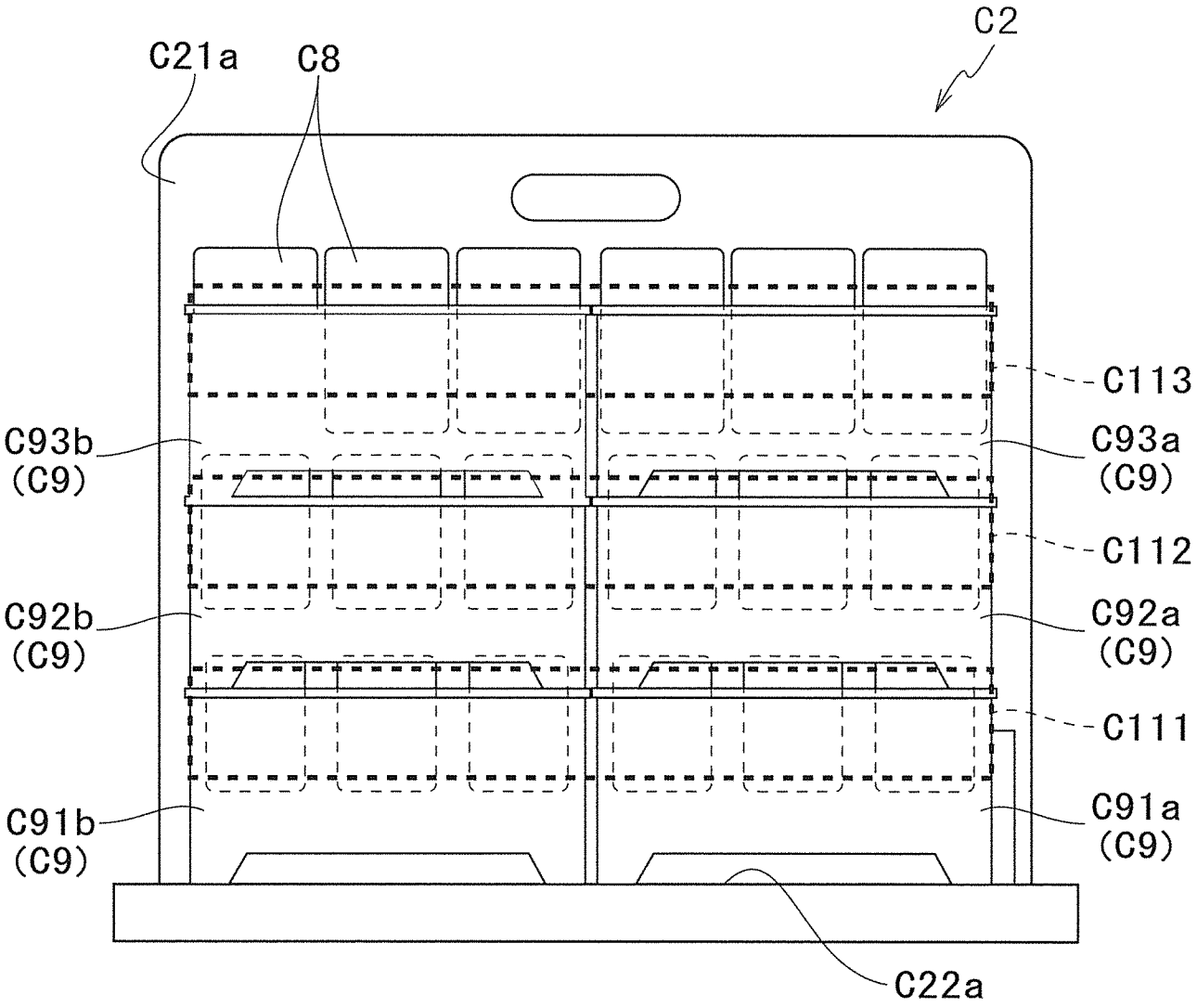
FIG. 23 is a front view showing a modification of the game medium accommodation device.

For example, as shown in FIG. 23, the tray mechanism C2 may be configured to allow a plurality of accommodation cases C9 to be stacked in M rows and N columns. Further, a reading region of an antenna may be set along each row having N accommodation cases C9 lined up in the horizontal direction. In the example shown in FIG. 23, each accommodation case C9 is capable of storing three bundles of the aligned game media C8 lined up in the horizontal direction. In the tray mechanism C2, the accommodation cases C9 are stacked in three rows and two columns.

Specifically, an accommodation case C91*a* and an accommodation case C91*b* are placed on the supporting surface C22*a* of the tray mechanism C2. An accommodation case C92*a* and an accommodation case C93*a* are stacked in sequence on the accommodation case C91*a*, and an accommodation case C92*b* and an accommodation case C93*b* are stacked in sequence on the accommodation case C91*b*. That is, the accommodation case C91*a* and the accommodation case C91*b* are lined up in the horizontal direction, the accommodation case C92*a* and the accommodation case C92*b* are lined up in the horizontal direction, and the accommodation case C93*a* and the accommodation case C93*b* are lined up in the horizontal direction. Thus, the stacked accommodation cases C9 are supported by the tray mechanism C2 while leaning against the inclined reading surface C21*a* of the tray mechanism C2.

On the other hand, antenna boards C111 to C113 are disposed on the reading surface C21*a*. The antenna board C111 is disposed on the reading surface C21*a* to face the accommodation case C91*a* and the accommodation case C91*b*. Similarly, the antenna board C112 is disposed on the reading surface C21*a* to face the accommodation case C91*a* and the accommodation case C91*b*, and the antenna board C111 is disposed on the reading surface C21*a* to face the accommodation case C93*a* and the accommodation case C93*b*. Thus, the antenna boards C111 to C113 are disposed along the respective rows of the plurality of accommodation cases C9 arranged in three rows and two columns. That is, the reading regions of the antenna boards C111 to C113 are set along the respective rows of the plurality of accommodation cases C9 arranged in three rows and two columns. Thus, the electronic information of the game media C8 accommodated in the accommodation cases 9C along the reading surface C21 is read by different antennas, which respectively correspond to the rows of the accommodation cases 9C.

Further, the detailed description above is mainly focused on characteristics of the present invention to for the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other configurations, systems, methods or the like are possible, within the spirit of the invention described in the present specification. The description of claims therefore shall encompass configurations equivalent to the present invention, unless otherwise such configurations are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. In the present specification, each process used to derive one result should be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Further, although the present specification occasionally personifies the processes carried out in the steps or blocks, these processes are essentially executed by various devices. Further, the other configurations necessary for the steps or blocks are obvious from the above descriptions.

What is claimed is:

1. A game medium accommodation device, comprising:

a plurality of elongated accommodation cases, each of which includes a plurality of discrete accommodation portions that are aligned with each other in a lengthwise direction of a given accommodation case and that are each configured to hold a bundle of game media;

a tray mechanism including a reading surface, the tray mechanism being configured to hold a plurality of the accommodation cases stacked in an up-down direction along the reading surface continuing in the up-down direction; and a reading mechanism including a plurality of horizontally extending antennas disposed along the reading surface with a single antenna being provided for each of the plurality of accommodation cases and the plurality of discrete accommodation portions included therein, the reading mechanism being configured to read electronic information relating to the game media and stored in the game media by radio communication between the game media and a respective one of the plurality of antennas, the reading mechanism including the same number of antennas as accommodation cases that the tray mechanism is configured to hold such that each of the plurality of antennas corresponds to and reads electronic information from the game media that are held in a single accommodation case, the reading mechanism being configured such that the electronic information for gaming media contained in a given accommodation portion is read individually for each accommodation portion included in a given accommodation case.

2. The game medium accommodation device according to claim 1, wherein the tray mechanism is configured to allow the accommodation cases to be stacked in M rows and N columns, and a reading region of each of the antennas is set along each row of the M rows, in each of which rows, N accommodation cases can be lined up in the horizontal direction.

3. A game medium accommodation device, comprising:

a plurality of elongated accommodation cases, each of which includes a plurality of discrete accommodation portions that are aligned with each other in a lengthwise direction of a given accommodation case and that are each configured to hold a bundle of game media;

a tray mechanism including a reading surface, the tray mechanism being configured to hold a plurality of the accommodation cases stacked in an up-down direction along the reading surface continuing in the up-down direction; and a reading mechanism including a plurality of horizontally extending antennas disposed along the reading surface with a single antenna being provided for each of the plurality of accommodation cases and the plurality of discrete accommodation portions included therein, the reading mechanism being configured to read electronic information relating to the game media and stored in the game media by radio communication between the game media and a respective one of the plurality of antennas, the reading mechanism including the same number of antennas as accommodation cases that the tray mechanism is configured to hold such that each of the plurality of antennas corresponds to and reads electronic information from the game media that are held in a single accommodation case, the reading mechanism being configured such that the electronic information for gaming media contained in a given accommodation portion is read individually for each accommodation portion included in a given accommodation case; wherein each accommodation portion of each accommodation case is configured to accommodate the game media, and each accommodation case includes a spacer member attachable/detachable with respect to at least one of the accommodation portions; and the spacer member is sized and shaped to keep the center portions of the lengthwise-aligned game media all aligned with each other and aligned with a reading region of a respective horizontally extending antenna even when the game media within a given accommodation case are of different types which are different in size.

4. A game medium accommodation device, comprising:

a plurality of elongated accommodation cases, each of which includes a plurality of discrete accommodation portions that are aligned with each other in a lengthwise direction of a given accommodation case and that are each configured to hold a bundle of game media;

a tray mechanism including a reading surface, the tray mechanism being configured to hold a plurality of the accommodation cases stacked in an up-down direction along the reading surface continuing in the up-down direction; and a reading mechanism including a plurality of horizontally extending antennas disposed along the reading surface with a single antenna being provided for each of the plurality of accommodation cases and the plurality of discrete accommodation portions included therein, the reading mechanism being configured to read electronic information relating to the game media and stored in the game media by radio communication between the game media and a respective one of the plurality of antennas, the reading mechanism including the same number of antennas as accommodation cases that the tray mechanism is configured to hold such that each of the plurality of antennas corresponds to and reads electronic information from the game media that are held in a single accommodation case, the reading mechanism being configured such that the electronic information for gaming media contained in a given accommodation portion is read individually for each accommodation portion included in a given accommodation case, wherein the tray mechanism has a pedestal portion that supports the tray mechanism in an upright orientation with an arrangement plate that forms the reading surface extending generally vertically from the pedestal portion, the pedestal portion having an upper placing surface and the reading surface being oriented perpendicularly to the placing surface, the pedestal portion further having a lower surface on which the tray mechanism sits when in use, and wherein the upper placing surface is inclined relative to the lower surface of the pedestal portion such that when the tray mechanism is placed on a horizontal support surface, the placing surface is inclined relative to horizontal and the reading surface is angled away from absolute vertical.

5. The game medium accommodation device according to claim 1, further comprising:

a display device; and a control device configured to obtain a total value of game value for each type of game media held within the accommodation cases based on the electronic information read by the reading mechanism, and to display the one or more total values on the display device in association with the type of the game media.

* * * * *